US008197260B2

(12) United States Patent
Wadsworth

(10) Patent No.: US 8,197,260 B2
(45) Date of Patent: Jun. 12, 2012

(54) ELECTRICAL CONNECTOR AND METHOD OF MANUFACTURING SAME

(75) Inventor: John Wadsworth, Burbank, CA (US)

(73) Assignee: Belkin International, Inc., Playa Vista, CA (US)

( * ) Notice: Subject to any disclaimer, the term of this patent is extended or adjusted under 35 U.S.C. 154(b) by 253 days.

(21) Appl. No.: 12/537,214

(22) Filed: Aug. 6, 2009

(65) Prior Publication Data

US 2009/0291570 A1 Nov. 26, 2009

Related U.S. Application Data

(63) Continuation-in-part of application No. 12/044,897, filed on Mar. 7, 2008, now abandoned.

(51) Int. Cl.
*H01R 39/00* (2006.01)

(52) U.S. Cl. ..... 439/27; 439/13; 439/373; 439/652

(58) Field of Classification Search ..... 439/11, 439/13, 20–22, 27, 31, 32, 33, 373, 640, 439/651, 652

See application file for complete search history.

(56) References Cited

U.S. PATENT DOCUMENTS

| | | | |
|---|---|---|---|
| 1,238,448 | A | 8/1917 | Shaw |
| 1,613,647 | A | 1/1927 | Davies et al. |
| 1,699,722 | A | 1/1929 | Stott |
| 1,699,958 | A | 1/1929 | Eby |
| 1,714,763 | A | 5/1929 | Boyson |
| 1,817,004 | A | 8/1931 | Hubbell, Jr. |
| 1,846,251 | A | 2/1932 | Donahue |
| 1,873,042 | A | 8/1932 | Rohrdanz |
| 1,950,036 | A | 3/1934 | Preston |
| 1,975,964 | A | 10/1934 | Mayhew |
| 1,978,805 | A | 10/1934 | McCloy et al. |
| 1,981,458 | A | 11/1934 | McCloy et al. |
| 1,984,181 | A | 12/1934 | French |
| 2,027,447 | A | 1/1936 | Percy |

(Continued)

FOREIGN PATENT DOCUMENTS

WO W09966605 A1 12/1999

OTHER PUBLICATIONS

Griffin Technology: PowerBlock travel; international charger; http://www.griffintechnology.com/products/powerblocktravel; Feb. 15, 2008; 3 pages.

(Continued)

*Primary Examiner* — James Harvey
(74) *Attorney, Agent, or Firm* — Bryan Cave LLP

(57) ABSTRACT

In one embodiment, an apparatus for providing electrical power comprises a housing, at least two electrical outlets, a rotation coupler at the housing and coupled to the at least two electrical outlets, and a prong adapter rotatable relative to the rotation coupler when secured thereto. The rotation coupler comprises a central contact, a first contact set, and a second contact set. The prong adapter comprises a first prong to couple with the first contact set, a second prong to couple with the second contact set, and a third prong to couple with the central contact. The first contact set comprises two or more first contact flanges to couple with the first prong at a rear of the prong adapter. The second contact set comprises two or more second contact flanges to couple with the second prong at the rear of the prong adapter. Other examples herein described.

27 Claims, 11 Drawing Sheets

U.S. PATENT DOCUMENTS

| | | | |
|---|---|---|---|
| 2,226,209 | A | 12/1940 | Rizutto |
| 2,301,258 | A | 11/1942 | Corlew |
| 2,305,100 | A | 12/1942 | O'Brien |
| 2,305,101 | A | 12/1942 | O'Brien |
| 2,326,181 | A | 8/1943 | Sundquist et al. |
| 2,425,679 | A | 8/1947 | Jackson |
| 2,433,938 | A | 1/1948 | Varner |
| 2,447,026 | A | 8/1948 | O'Brien |
| 2,474,070 | A | 6/1949 | Sokolik |
| 2,542,609 | A | 2/1951 | Wyglendowski |
| 2,542,935 | A | 2/1951 | McElroy |
| 2,564,159 | A | 8/1951 | Greacen, Jr. |
| 2,570,784 | A | 10/1951 | Ferguson |
| 2,645,759 | A | 7/1953 | Solari |
| 2,654,869 | A | 10/1953 | Mudd, Jr. |
| 2,855,578 | A | 10/1958 | Hirsch |
| 2,869,102 | A | 1/1959 | Hubbell, Jr. |
| 2,892,172 | A | 6/1959 | McGann, Jr. |
| 2,894,242 | A | 7/1959 | Bickford et al. |
| 2,898,572 | A | 8/1959 | Shinn |
| 3,032,740 | A | 5/1962 | Von Hoorn |
| 3,045,201 | A | 7/1962 | Hall |
| 3,137,536 | A | 6/1964 | Healy |
| 3,335,395 | A | 8/1967 | Smith |
| 3,355,695 | A | 11/1967 | Overesch |
| 3,392,362 | A | 7/1968 | Lipinski |
| 3,474,376 | A | 10/1969 | Preiss |
| 3,479,632 | A | 11/1969 | Galles |
| 3,718,890 | A | 2/1973 | Sheldon |
| 3,747,049 | A | 7/1973 | Cressman et al. |
| 3,760,338 | A | 9/1973 | Bruels |
| 3,860,312 | A | 1/1975 | Gordon, Jr. |
| 3,873,951 | A | 3/1975 | Blake |
| 3,950,069 | A | 4/1976 | Wiley |
| 3,975,075 | A | 8/1976 | Mason |
| 4,026,618 | A | 5/1977 | Straka |
| D246,241 | S | 11/1977 | Jacobs |
| 4,086,643 | A | 4/1978 | Jacobs |
| 4,307,925 | A | 12/1981 | Drew |
| D270,628 | S | 9/1983 | Bobrovniczky |
| 4,484,185 | A | 11/1984 | Graves |
| 4,488,201 | A | 12/1984 | Webb et al. |
| D280,894 | S | 10/1985 | Dickey |
| 4,567,544 | A | 1/1986 | Ronemus et al. |
| 4,643,508 | A | 2/1987 | Schaller |
| 4,679,884 | A | 7/1987 | Klemp |
| 4,743,999 | A | 5/1988 | Hames |
| 4,771,367 | A | 9/1988 | Serr et al. |
| 4,773,866 | A | 9/1988 | Basques |
| 4,857,013 | A | 8/1989 | Peters |
| 4,927,376 | A | 5/1990 | Dickie |
| 5,114,352 | A | 5/1992 | Gahagen et al. |
| 5,249,970 | A | 10/1993 | Jennings |
| 5,399,093 | A | 3/1995 | Schneider et al. |
| 5,466,165 | A | 11/1995 | Boesel et al. |
| 5,595,503 | A | 1/1997 | Pittman et al. |
| 5,660,554 | A | 8/1997 | Mead |
| 5,684,689 | A | 11/1997 | Hahn |
| 5,734,542 | A | 3/1998 | Cohen |
| 5,775,921 | A | 7/1998 | Chou |
| 5,957,701 | A | 9/1999 | McMillin |
| 5,997,310 | A | 12/1999 | Chiu et al. |
| 6,004,138 | A | 12/1999 | Harbertson |
| 6,039,608 | A | 3/2000 | Amero, Jr. et al. |
| 6,089,921 | A | 7/2000 | Chou |
| 6,116,958 | A | 9/2000 | Reichle |
| 6,669,495 | B2 | 12/2003 | Philips et al. |
| 6,862,403 | B2 | 3/2005 | Pedrotti et al. |
| 6,902,406 | B1 | 6/2005 | Kraus |
| 6,923,667 | B1 | 8/2005 | Chen |
| 6,942,508 | B2 | 9/2005 | Wong |
| 6,984,153 | B2 | 1/2006 | Lai et al. |
| 7,063,563 | B1 | 6/2006 | Hsu |
| 7,066,767 | B2 | 6/2006 | Liao |
| 7,168,968 | B1 | 1/2007 | Li |
| 7,168,969 | B1 | 1/2007 | Wang |
| 7,220,139 | B1 | 5/2007 | Chang et al. |
| 7,273,384 | B1 | 9/2007 | So |
| 7,445,513 | B1 | 11/2008 | Lee |
| 7,462,074 | B1 | 12/2008 | Devlin et al. |
| 2005/0250375 | A1 | 11/2005 | Allison |
| 2006/0030168 | A1 | 2/2006 | Miura |
| 2007/0278996 | A1 | 12/2007 | So |
| 2008/0261430 | A1 | 10/2008 | Wadsworth |
| 2009/0225486 | A1* | 9/2009 | Wadsworth ..... 361/118 |
| 2009/0291570 | A1* | 11/2009 | Wadsworth ..... 439/13 |
| 2011/0021040 | A1* | 1/2011 | Garb et al. ..... 439/13 |

OTHER PUBLICATIONS

Cyberguys.com; 360 Rotating Single Outlet Surge, Grounged; http://www.cyberguys.com/templates/SearchDetail.asp?productID=13122; Feb. 15, 2008; 2 pages.

Belkin 6-Socket SurgeMaster@Superior Series with Telephone Protection; http://catalog.belkin.com/IWCatProductPage.process?Product_Id=135152; Mar. 7, 2008; 2 pages.

Belkin: Travel Surge Protector with Hidden Swivel Plug; http://catalog.belkin.com/IWCatProductPage.process?Product_Id=182400; retrieved from the internet on Jan. 29, 2008.

Powergaurd model No. PGNP3452; http://wwwrkcable.com.au/PowergaurdPGNP3452.htm; retrieved from the internet on Jan. 29, 2008.

International Search Report for Application No. PCT/US 09/36301, dated Jan. 11, 2010.

International Search Report and Written Opinion from PCT/US2010/044791, 12 pages, Oct. 6, 2010.

* cited by examiner

FIG. 13
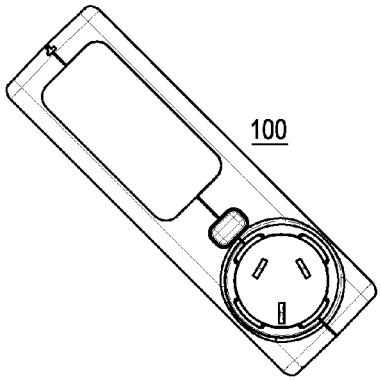
FIG. 9
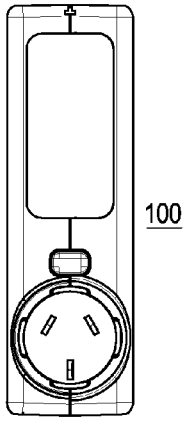
FIG. 12
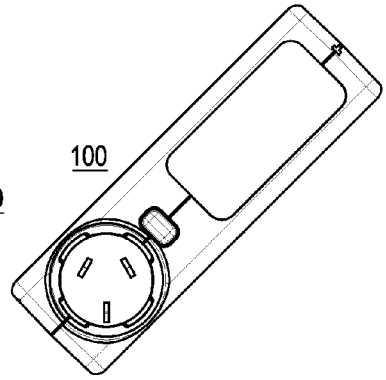
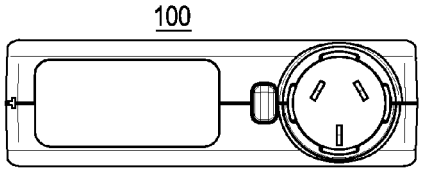
FIG. 10
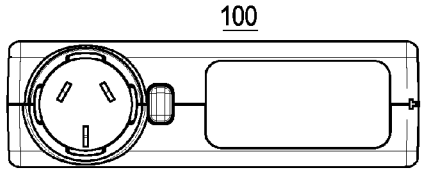
FIG. 8
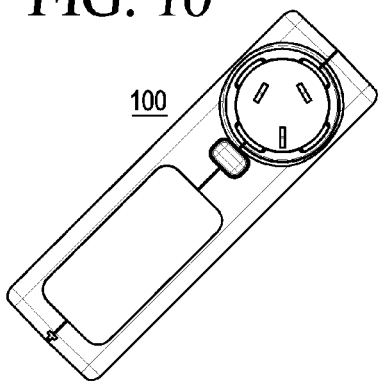
FIG. 14
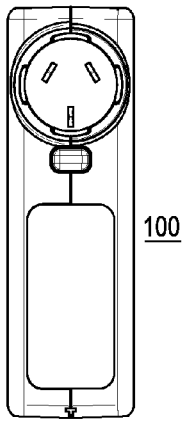
FIG. 11
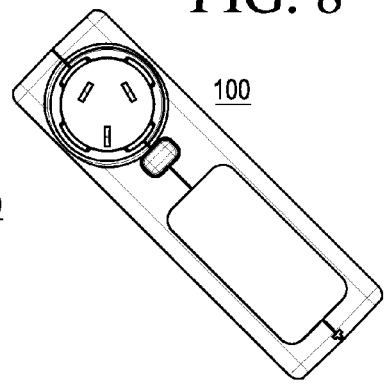
FIG. 15

ELECTRICAL CONNECTOR AND METHOD OF MANUFACTURING SAME

CLAIM OF PRIORITY

This application is a continuation-in-part non-provisional patent application claiming priority to U.S. patent application Ser. No. 12/044,897, filed on Mar. 7, 2008, titled Electrical Connector and Method of Manufacturing Same.

TECHNICAL FIELD

This invention relates generally to electrical connectors, and relates more particularly to rotatable electrical connectors.

BACKGROUND

Electrical connectors, such as surge protectors, can be used to couple electrical products to power sources. Many electrical connectors, however, are undesirable in some circumstances, including travel applications, when it comes to providing flexibility and functionality for coupling electrical products to power sources. Also, most electrical connectors designed for travel applications are ungrounded, and thus are incompatible for electrical products with polarized electrical prongs, or plugs incorporating a ground prong. Other electrical connectors are too unwieldy for travel applications because they comprise bulky power cords or are fixed in one orientation defined by the alignment of their power prongs relative to prong sockets on the power source. This configuration in turn forces electrical products and/or their power plugs to couple to the electrical connector at one specific orientation, which may not be suitable for the particular electric product, or the particular location where the power source is situated. In addition, most electrical connectors are limited to couple with only one type of power source outlet, and thus cannot couple to power sources in countries with different electrical standards and/or different power source outlets.

Accordingly, a need exists for a compact electrical connector that addresses these problems by providing more flexibility for coupling to different power sources, and more alignment options for coupling electrical products.

BRIEF DESCRIPTION OF THE DRAWINGS

The invention will be better understood from a reading of the following detailed description of examples of embodiments, taken in conjunction with the accompanying figures in the drawings in which:

FIG. 8 illustrates a front view of the electrical connector of FIG. 1 at a first predetermined orientation.

FIG. 9 illustrates a front view of the electrical connector of FIG. 1 at a second predetermined orientation.

FIG. 10 illustrates a front view of the electrical connector of FIG. 1 at a third predetermined orientation.

FIG. 11 illustrates a front view of the electrical connector of FIG. 1 at a fourth predetermined orientation.

FIG. 12 illustrates a front view of the electrical connector of FIG. 1 at a fifth predetermined orientation.

FIG. 13 illustrates a front view of the electrical connector of FIG. 1 at a sixth predetermined orientation.

FIG. 14 illustrates a front view of the electrical connector of FIG. 1 at a seventh predetermined orientation.

FIG. 15 illustrates a front view of the electrical connector of FIG. 1 at an eighth predetermined orientation.

Figure 1:
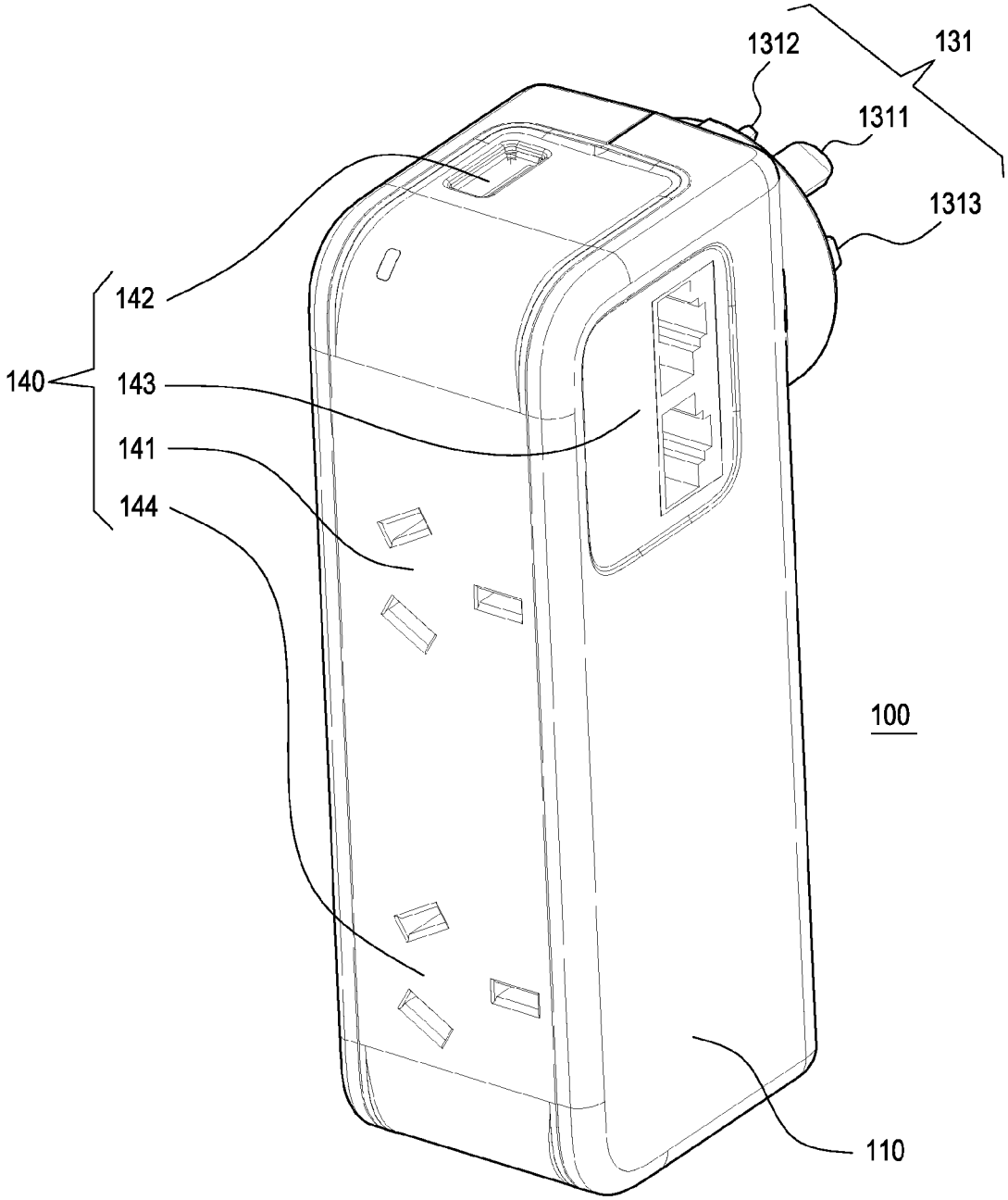
FIG. 1 illustrates a top, side, rear isometric view of an electrical connector, showing a prong adapter coupled to the electrical connector's housing via a rotation coupler, according to a first embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of examples of embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, physically, mechanical, or other manner. The term "ring," as used herein, includes items with a general annular, elliptical, polygonal, circular, and/or oval shape.

DETAILED DESCRIPTION

In one embodiment, an electrical connector comprises a housing, at least two electrical outlets accessible through the housing, a rotation coupler at least partially enclosed by the housing and coupled to the at least two electrical outlets, and a prong adapter coupled to the rotation coupler. The rotation coupler comprises a line contact, a neutral contact, and a ground contact. The prong adapter comprises a prong set with at least two of a line prong configured to couple with the line contact, a neutral prong configured to couple with the neutral contact, and a ground prong configured to couple with the ground contact. The rotation coupler is configured to allow a rotational movement of the housing relative to the prong adapter.

In a second embodiment, an apparatus for providing electrical power comprises a housing, at least two electrical outlets at the housing, a rotation coupler at least partially enclosed by the housing and coupled to the at least two electrical outlets, and a prong adapter rotatable relative to the rotation coupler when secured to the rotation coupler. The rotation coupler comprises: a first contact set comprising a first one of a line contact, a neutral contact, or a ground contact; a second contact set comprising a second one of the line contact, the neutral contact, or the ground contact; and a central contact comprising a third one of the line contact, the neutral contact, or the ground contact. The prong adapter comprises a prong set comprising a first prong configured to couple with the first contact set of the rotation coupler and comprising a first one of a line prong, a neutral prong, or a ground prong; a second prong configured to couple with the second contact set of the rotation coupler and comprising a second one of the line prong, the neutral prong, or the ground prong; and a third prong configured to couple with the central contact of the rotation coupler and comprising a third one of the line prong, the neutral prong, or the ground prong. The first contact set comprises two or more first contact flanges configured to couple with the first prong at a rear of the prong adapter, and the second contact set comprises two or more second contact flanges configured to couple with the second prong at the rear of the prong adapter.

Figure 2:
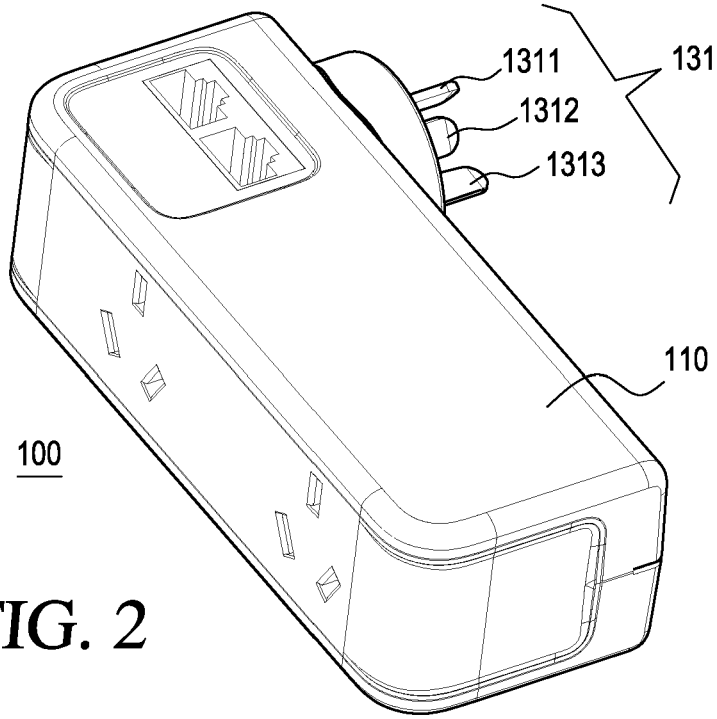
FIG. 2 illustrates a bottom, side, rear isometric view of the electrical connector from FIG. 1.
Figure 3:
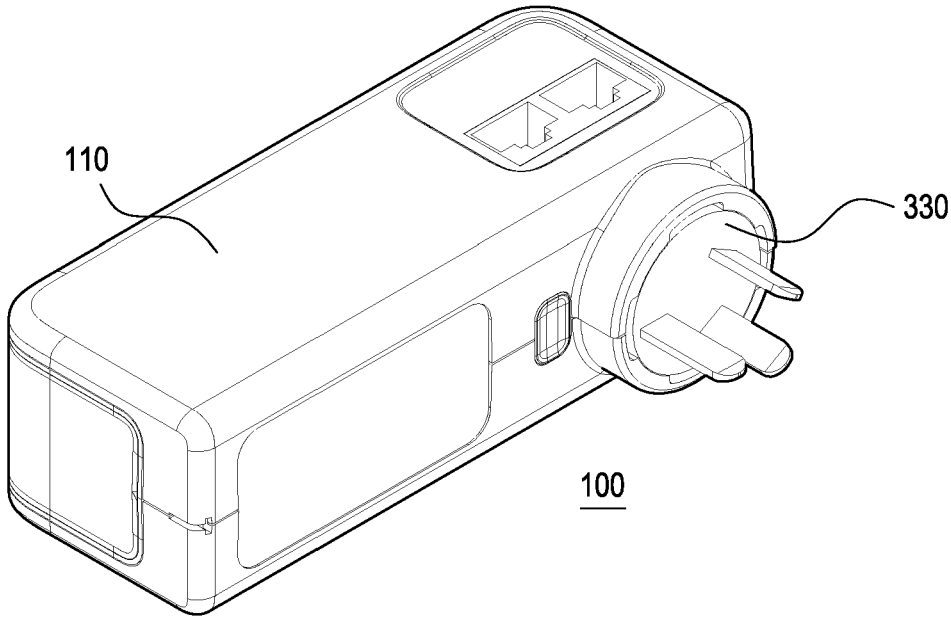
FIG. 3 illustrates a bottom, side, front isometric view the electrical connector from FIG. 1
Figure 4:
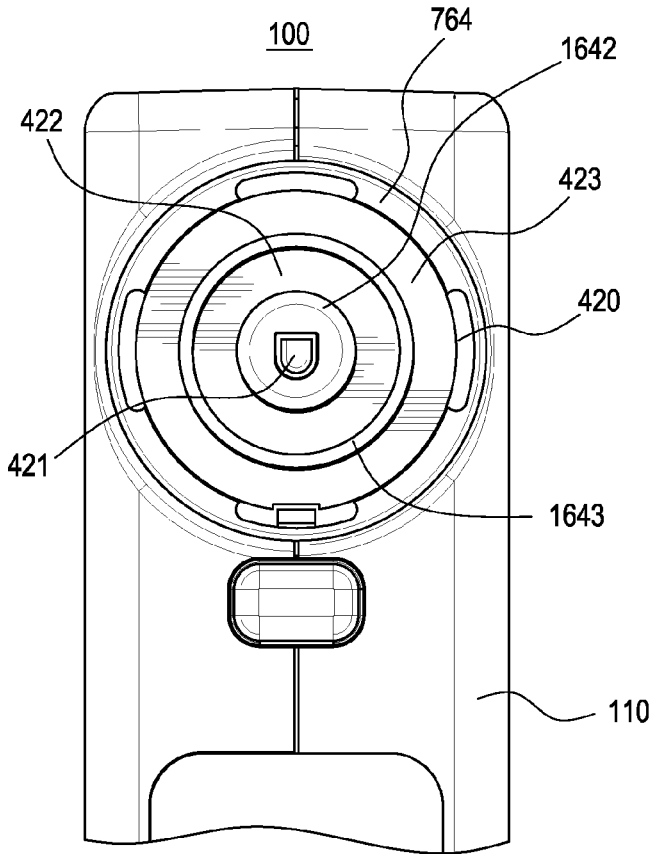
FIG. 4 illustrates a front view of a portion of the electrical connector from FIG. 1, showing the prong adapter decoupled form the rotation coupler.
Figure 5:
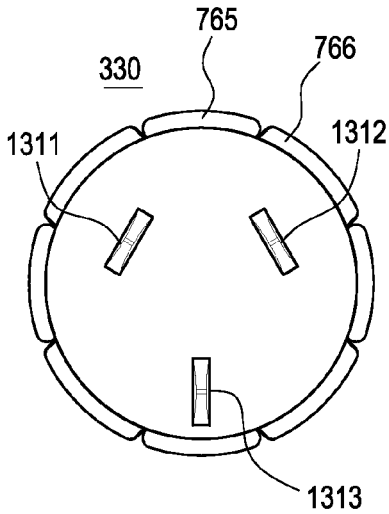
FIG. 5 illustrates a front view of the prong adapter from FIGS. 1-3.
Figure 6:
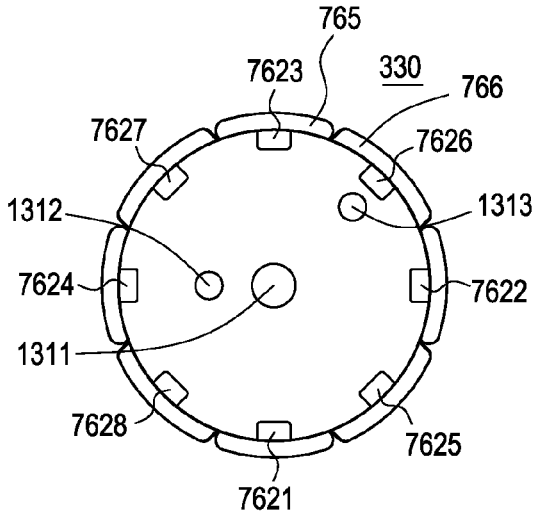
FIG. 6 illustrates a rear view of the prong adapter from FIGS. 1-3.
Figure 7:
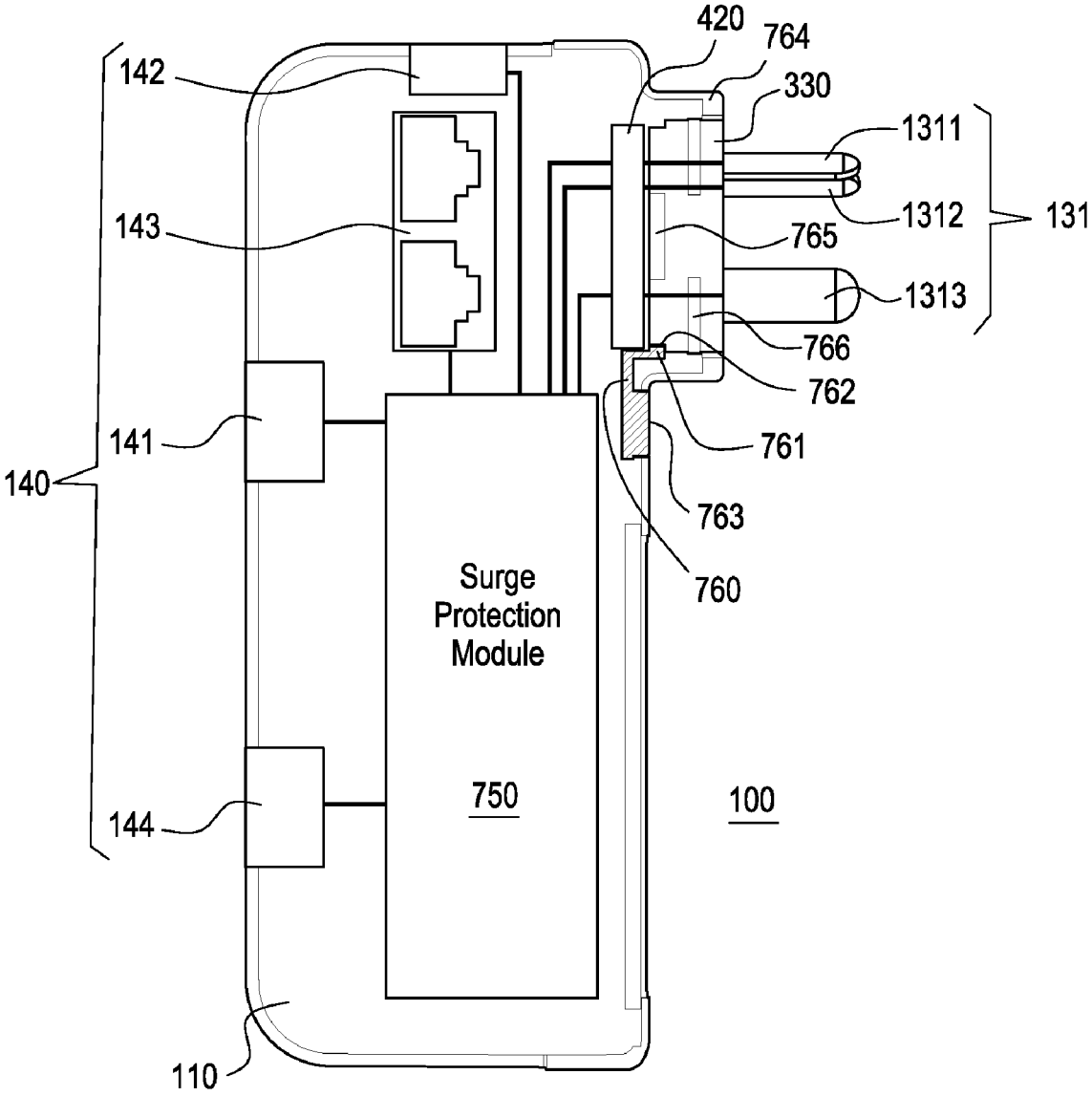
FIG. 7 illustrates a cross sectional view of the electrical connector of FIG. 1, showing a locking mechanism and internal connections of different elements.

Turning to the drawings, FIG. 1 illustrates a top, side, rear isometric view of electrical connector 100, according to a first embodiment. FIG. 2 illustrates a bottom, side, rear isometric view of electrical connector 100. FIG. 3 illustrates a bottom, side, front isometric view of electrical connector 100. FIG. 4 illustrates a front view of a portion of electrical connector 100, with prong adapter 330 decoupled from rotation coupler 120. FIG. 5 illustrates a front view of prong adapter 330. FIG. 6 illustrates a rear view of prong adapter 330. FIG. 7 illustrates a cross sectional view of electrical connector 100, showing internal connections of different elements. FIG. 8 illustrates a front view of electrical connector 100 at a first predetermined orientation of housing 110 relative to prong adapter 330. FIG. 9 illustrates a front view of electrical connector 100 at a second predetermined orientation. FIG. 10 illustrates a front view of electrical connector 100 at a third predetermined orientation. FIG. 1 illustrates a front view of electrical connector 100 at a fourth predetermined orientation. FIG. 12 illustrates a front view of electrical connector 100 at a fifth predetermined orientation. FIG. 13 illustrates a front view of electrical connector 100 at a sixth predetermined orientation. FIG. 14 illustrates a front view of electrical connector 100 at a seventh predetermined orientation. FIG. 15 illustrates a front view of electrical connector 100 at an eighth predetermined orientation.

Electrical connector 100 is merely exemplary and is not limited to the embodiments presented herein. Electrical connector 100 can be employed in many different embodiments or examples not specifically depicted or described herein.

In the example shown in FIGS. 1-15, electrical connector 100 comprises a housing 110, with rotation coupler 420 (FIG. 4) at least partially enclosed by housing 110, and with electrical outlets 140 accessible through the exterior of housing 110. Electrical connector 100 further comprises prong adapter 330 (FIG. 3), with prong set 131, coupled to housing 110 via rotation coupler 420. Electrical connector 100 can comprise, for example, a power strip or power bar.

In one embodiment, housing 110 can have dimensions of approximately 130×50×41 millimeters (mm). In the same or a different embodiment, housing 110 can comprise a neck with a diameter of approximately 38.5 mm protruding from housing 110 a distance of approximately 9 mm. In a different embodiment, any of the listed dimensions of housing 110 can be increased or decreased by up to 30 mm.

In the present embodiment, electrical outlets 140 comprise AC outlet 141, USB outlet 142, Ethernet outlet 143, and AC outlet 144. In a different embodiment, electrical connector 100 can comprise other combinations of electrical outlets 140, including different types of electrical outlets 140 not specifically shown in the example of FIGS. 1-15 such as telephone jacks.

In the example of FIGS. 1-15, one or more of electrical outlets 140 are electrically coupled to prong set 131 via the interior of housing 110 (FIG. 7). Electrical connector 100 can thus be used to provide an electrical connection from an electrical source (not shown) coupled to prong set 131 to one or more electrical devices (not shown) coupled to one or more of electrical outlets 140. In one example, the electrical source can be an AC wall outlet to which prong set 131 of prong adapter 330 couples. In a different example, the electrical source can be an extension cord or another power bar or strip comprising outlets to which prong set 131 can also couple.

In the same or a different example, electrical connector 100 can comprise surge protection module 750 (FIG. 7) contained within housing 110 and coupled to electrical outlets 140 to protect any electrical devices coupled to electrical outlets 140 from voltage spikes or other power conditioning inconsistencies of the electrical source by, for example, blocking or shorting to ground voltages above a safe threshold.

Surge protection module 750 can be electrically coupled between rotation coupler 420 and electrical outlets 140 (FIG. 7). In such an example, when prong adapter 330 couples to rotation coupler 120, the surge protection module lies along the electrical path between prong set 131 and electrical outlets 140 to restrict power conditioning inconsistencies from reaching or affecting the electrical devices coupled to electrical outlets 140. In a different example, surge protection module 750 may not be provided, and the electrical path between electrical outlets 140 and prong set 131 would be more direct while foregoing protection against power conditioning inconsistencies.

As illustrated in FIGS. 4-6, the rotation coupler 420 of electrical connector 100 comprises contact 421, contact 422, and contact 423, while prong adapter 330 comprises at least two of prong 1311, prong 1312, and prong 1313. Parts of prongs 1311-1313 that protrude and/or are accessible through the rear of prong adapter 330 configured to contact rotation coupler 420 can be referred to as couplers. Electrical connector 100 is configured such that, when prong adapter 330 is coupled to rotation coupler 420, contact 421 couples to prong 1311, and contact 422 couples to prong 1312. In addition, for cases where prong adapter 330 comprises prong 1313, contact 423 couples to prong 1313 when prong adapter 330 is coupled to rotation coupler 420. In this embodiment, prong 1313 can be a ground prong.

Different prongs may be assigned different characteristics in different embodiments. However, as will be seen from the following examples, the coupling relationship between one type of prong and the corresponding type of contact remains constant.

In one example, prong 1311 and contact 421 comprise a line prong and a line contact, respectively, and prong 1312 and contact 422 comprise a neutral prong and a neutral contact, respectively, while prong 1313 and contact 423 comprise a ground prong and a ground contact, respectively.

In a different example, prong 1311 and contact 421 comprise a line prong and a line contact, respectively, and prong 1312 and contact 422 comprise a ground prong and a ground contact, respectively, while prong 1313 and contact 423 comprise a neutral prong and a neutral contact, respectively.

In an alternate example, prong 1311 and contact 421 comprise a neutral prong and a neutral contact, respectively, and prong 1312 and contact 422 comprise a line prong and a line contact, respectively, while prong 1313 and contact 423 comprise a ground prong and a ground contact, respectively.

In another different example, prong 1311 and contact 421 comprise a neutral prong and a neutral contact, respectively, and prong 1312 and contact 422 comprise a ground prong and a line contact, respectively, while prong 1313 and contact 423 comprise a line prong and a line contact, respectively.

In another alternate example, prong 1311 and contact 421 comprise a ground prong and a ground contact, respectively, and prong 1312 and contact 422 comprise a line prong and a line contact, respectively, while prong 1313 and contact 423 comprise a neutral prong and a neutral contact, respectively.

In yet another different example, prong 1311 and contact 421 comprise a ground prong and a ground contact, respectively, and prong 1312 and contact 422 comprise a neutral prong and a neutral contact, respectively, while prong 1313 and contact 423 comprise a line prong and a line contact, respectively.

In yet another alternate example, other combinations can be possible, including examples where prong adapter 330 comprises only two of prong 1311, prong 1312, and prong 1313.

In many embodiments, however, the line prong is configured to couple to the line contact, the neutral prong is configured to couple to the neutral contact, and the ground prong is configured to couple to the ground contact, when rotation coupler 420 is coupled to prong adapter 330. In one embodiment, this configuration can be achieved by placing the line contact a first distance away from a center of rotation coupler 420, the neutral contact a second distance away from the center of rotation coupler 420, and the ground contact a third distance away from the center of rotation coupler 420 (FIG. 4), while locating a line coupler of the line prong a first distance away from a center of prong adapter 330, a neutral coupler of the neutral prong a second distance away from the center of prong adapter 330, and a ground coupler of the ground prong a third distance away from the center of prong adapter 330 (FIG. 6), wherein the first, second, and third distance from the center of rotation coupler 420 are substantially equal, respectively, to the first, second and third distance from the center of prong adapter 330.

As illustrated in FIGS. 8-15, rotation coupler 420 is configured to allow a rotational movement of housing 110 relative to prong adapter 330. In the present embodiment of FIGS. 1-15, the rotational movement of housing 110 comprises 360 degrees relative to prong adapter 330. In a different example, the rotational movement of housing 110 could be limited to a subset of 360 degrees relative to prong adapter 330.

In the present embodiment, as illustrated in FIGS. 6 and 7, rotation coupler 420 comprises a portion of a locking mechanism 760. The portion of locking mechanism 760 comprises a lock 761 coupled to rotation coupler 420 (FIG. 7). In addition, prong adapter 330 comprises a second portion of locking mechanism 760 with two or more lock receivers 762 complementary to lock 761 (FIG. 6-7). In the present example, the two or more lock receivers 762 comprise eight lock receivers 7621-7628 spaced around prong adapter 330 in increments comprising multiples of 45 degrees of rotation. In a different example, the two or more lock receivers 762 could be spaced around prong adapter 330 at other multiples of 45 degrees of rotation, such as every 90 degrees, or at other non-45-degree multiples.

The locations of the two or more lock receivers 762 (FIG. 6) of the prong adapter 330 define two or more predetermined orientations along the rotational movement of housing 110 relative to prong adapter 330 (FIGS. 8-15). In the present example, locking mechanism 760 is configured to restrict the rotational movement of the housing 110 relative to prong adapter 330 at eight predetermined orientations, separated from each other by one or more multiples of 45 degrees of rotation, (FIGS. 8-15) when lock 761 couples to a respective one of the two or more lock receivers 762 of prong adapter 330 (FIG. 7). In addition, locking mechanism 760 is configured to permit the rotational movement of housing 110 relative to prong adapter 330 when lock 761 is not coupled to any of the two or more lock receivers 762.

In the present embodiment, as shown in FIG. 7, locking mechanism 760 comprises a lock de-actuator 763 coupled to lock 761 and protruding through an exterior of housing 110. Lock de-actuator 763 can be operated by pressing it against housing 110, causing lock 761 to decouple from any of the two or more lock receivers 762 of prong adapter 330 to allow the rotational movement of housing 110 relative to prong adapter 330.

Figure 16:
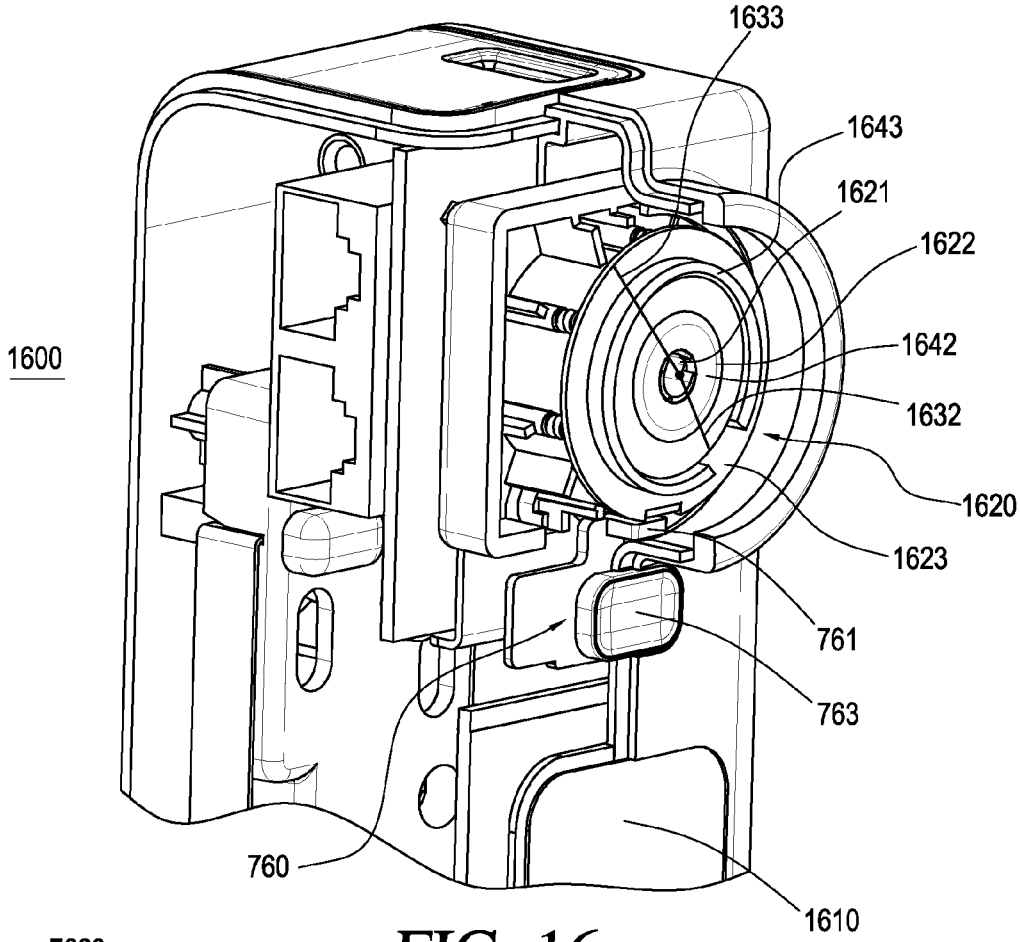
FIG. 16 illustrates a cross sectional, isometric view of a portion of an electrical connector, which is a similar embodiment of the electrical connector of FIGS. 1-15, without a prong adapter.
Figure 17:
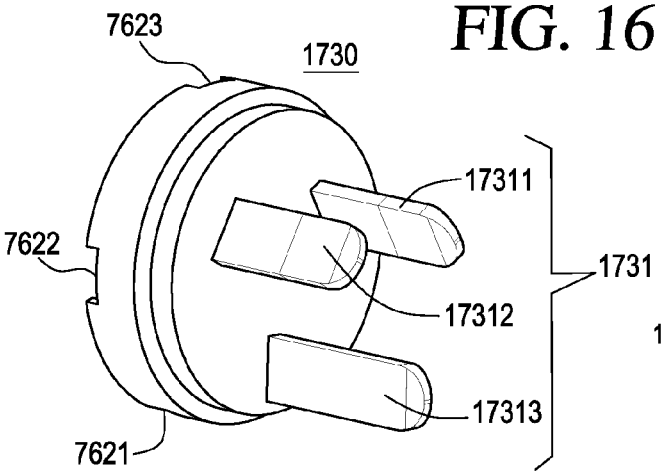
FIG. 17 illustrates an isometric front view of a prong adapter of the electrical connector of FIG. 16.
Figure 18:
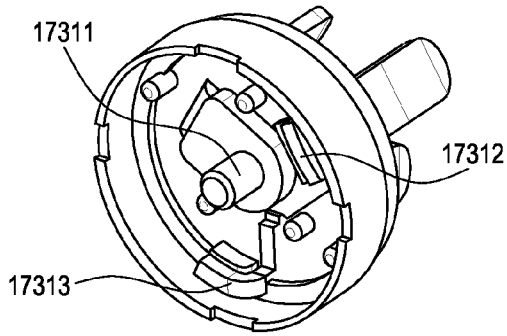
FIG. 18 illustrates an isometric rear view of the prong adapter of FIG. 17.

Continuing with the figures, FIG. 16 illustrates a cross sectional, isometric view of a portion of electrical connector 1600, which is a similar embodiment of electrical connector 100 of FIGS. 1-15. FIG. 17 illustrates an isometric front view of a prong adapter 1630. FIG. 18 illustrates an isometric rear view of prong adapter 1630.

As illustrated in FIG. 16, electrical connector 1600 comprises a rotation coupler 1620 comprising prong contact 1621, prong contact 1622, and prong contact 1623 similar to contact 421, contact 422, and contact 423 of rotation coupler 420 (FIG. 4), respectively, for electrical connector 100.

Rotation coupler 1620 is configured with concentric rail contacts such as contacts 1622 and 1623. In the present embodiment, the different prong contacts comprise full rings of different perimeters, with contact 1622 defined by a ring of radius 1632, and contact 1623 defined by a ring of radius 1633. In a different embodiment, the different prong contacts may comprise only part of a full ring. In either case, an outer perimeter of contact 1621 is located within, and electrically isolated from, an inner perimeter of contact 1622. Similarly, an outer perimeter of prong contact 1622 is located within, and electrically isolated from, an inner perimeter of prong contact 1623. In the present embodiment, contacts 1621 and 1622 are electrically isolated from each other by isolation barrier 1642, while contacts 1622 and 1623 are electrically isolated from each other by isolation barrier 1643, where isolation barriers 1642 and 1643 comprise rings of nonconductive material. The rings can be continuous or discontinuous.

As illustrated in FIGS. 17-18, rotation coupler 1620 couples to prong adapter 1730, similar to prong adapter 330 of electrical connector 100 (FIGS. 5-6). Prong adapter 1730 comprises a prong set 1731, having at least two of prong 17311, prong 17312, and prong 17313. In the present example, all three prongs are present in prong set 1731.

As can be seen in FIG. 18, the different prongs of prong set 1731 protrude through the rear of prong adapter 1730. In the same or a different example, the different prongs do not protrude through the rear of prong adapter 1730 at a point directly opposite to the respective prong at the front of prong adapter 1730 (FIG. 17). Instead, they are routed internally through prong adapter 1730 to protrude at a point aligned with the perimeter of their respective prong contact at rotation coupler 120. In the present example, prong 17311 protrudes through the center of the rear of prong adapter 1730, lining up with prong contact 1621 (FIG. 16) at the center of rotation coupler 1620. Similarly, prong 17312 protrudes through the rear of prong adapter 1730 at a point separated from the center of prong adapter 1730 by radius 1632, the same radius that defines prong contact 1622 (FIG. 16). Likewise, prong 17313 protrudes through the rear of prong adapter 1730 at a point separated from the center of prong adapter 1730 by radius 1633, the same radius that defines prong contact 1623 (FIG. 16).

Because of the radial alignments described above, when prong adapter 1730 (FIGS. 17-18) is coupled to rotation coupler 1620 (FIG. 16), prong contact 1621 couples with prong 17311, and prong contact 1622 couples with prong 17312. In addition, while housing 1610 is rotated relative to prong adapter 1730, prong contact 1621 remains coupled to prong 17311, and prong contact 1622 remains coupled to prong 17312.

In the present and other embodiments where prong adapter 1730 comprises each of prong 17311, prong 17312, and prong 17313, prong contact 1623 couples with prong 17313 when prong adapter 1730 is coupled to rotation coupler 1620. In addition, while housing 1610 is rotated relative to prong adapter 1730, prong contact 1623 remains coupled to prong 17313.

Although electric connector 1600 is shown in an exploded view in FIGS. 16-18, with prong adapter 1730 separated from rotation coupler 1620, electric connector 1600 can be configured such that prong adapter 1730 is not removable from rotation coupler 1620, while still retaining the capability of allowing rotational movement.

Figure 23:
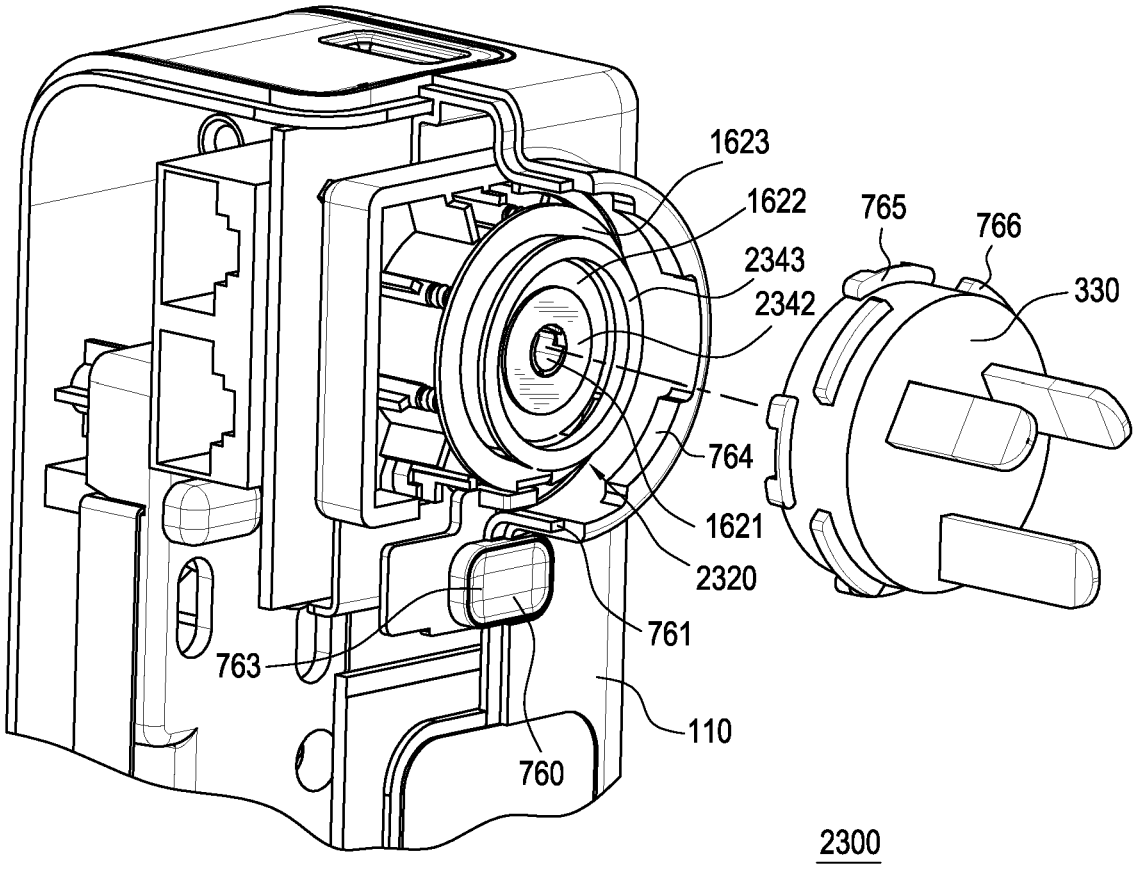
FIG. 23 illustrates a cross sectional, isometric view of a portion of an electrical connector, which is a similar embodiment of the electrical connector of FIG. 16.

Skipping ahead with the figures, FIG. 23 illustrates a rotation coupler 2320, which is a related embodiment of rotation coupler 1620 from FIG. 16. Rotation coupler 2320 differs from rotation coupler 1620 by further comprising retainer ring 2342 coupled to a top of isolation barrier 1642 (FIG. 16), and retainer ring 2343 coupled to a top of the isolation barrier 1643 (FIG. 16). Retainer rings 2342 and 2343 keep the contacts 1621-1623 in place when prong adapter 330 is removed from rotation coupler 2320. Under such circumstances, retainer ring 2342 couples with and retains the outer perimeter of prong contact 1621 and the inner perimeter of prong contact 1622, while retainer ring 2343 couples with and retains the outer perimeter of prong contact 1622 and the inner perimeter of prong contact 1623.

Figure 19:
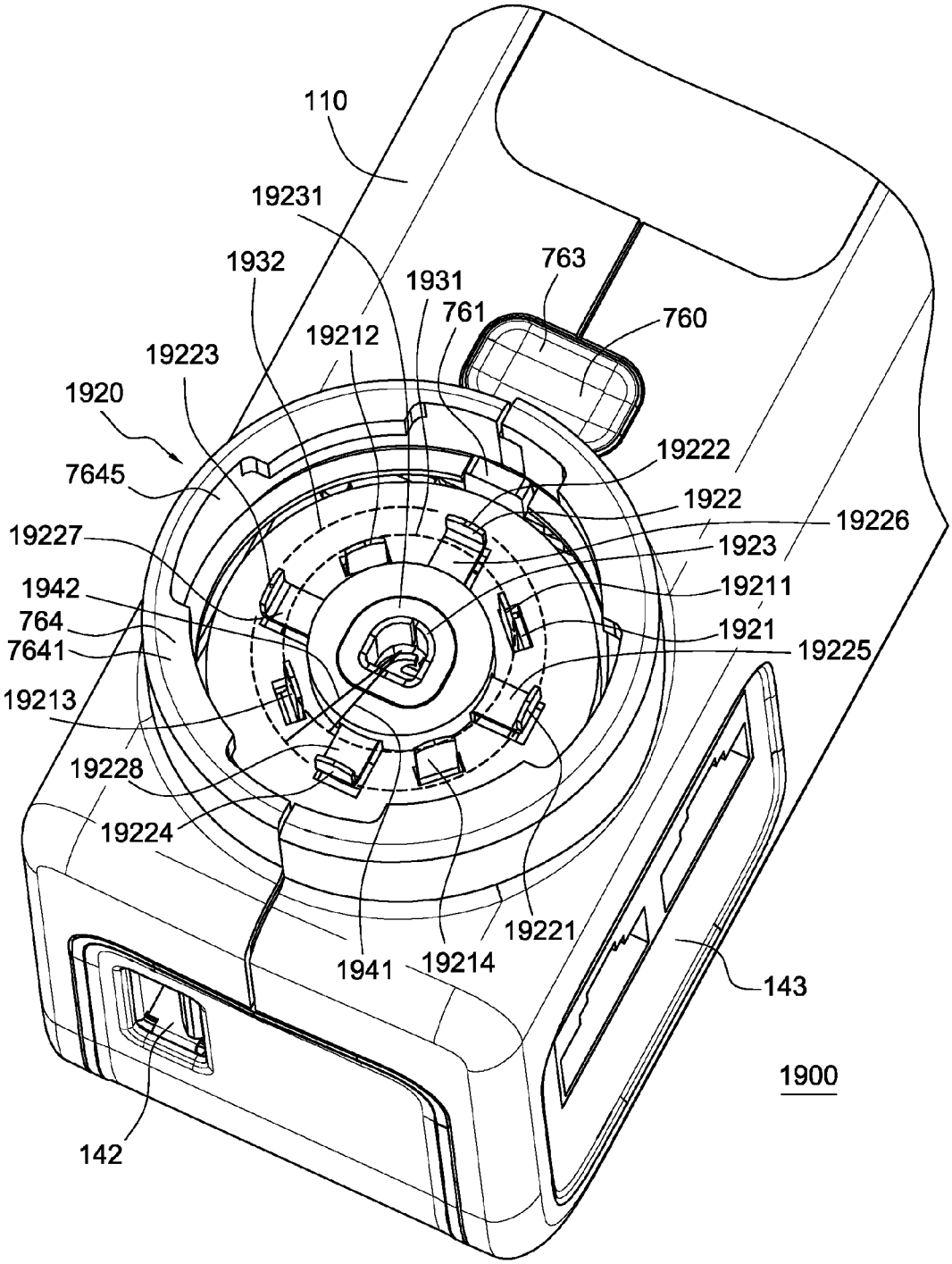
FIG. 19 illustrates an isometric view of a portion of an electrical connector, which is a similar embodiment of the electrical connector of FIGS. 1-15 and the electrical connector of FIGS. 16-18, without a prong adapter.
Figure 20:
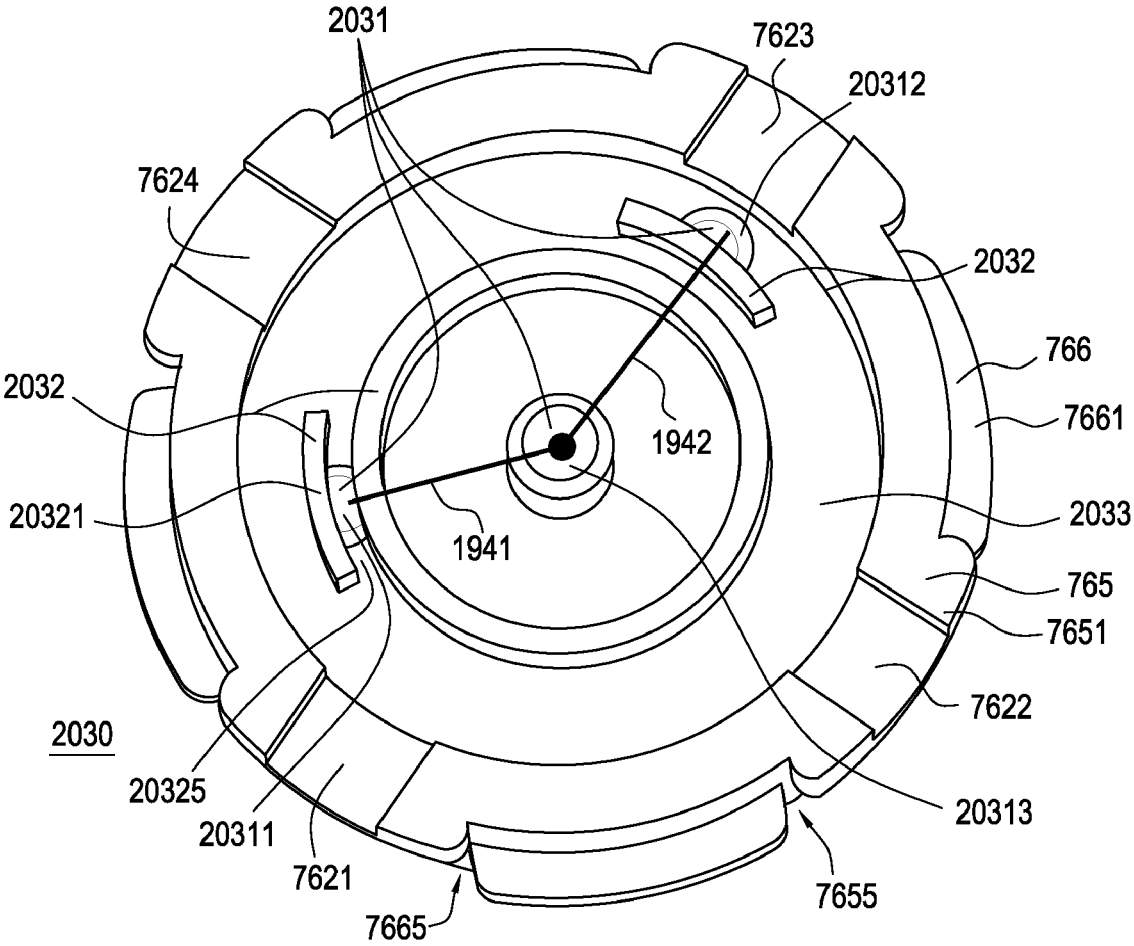
FIG. 20 illustrates a rear view of a prong adapter of the electrical connector of FIG. 19.
Figure 21:
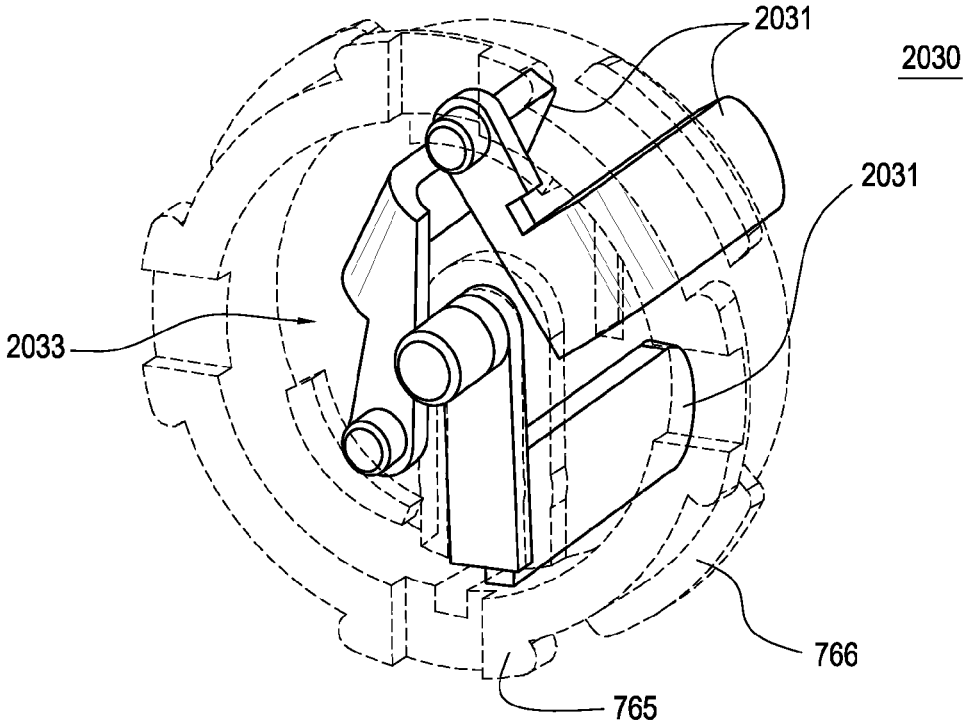
FIG. 21 illustrates a translucent rear view of the prong adapter of FIG. 20.
Figure 22:
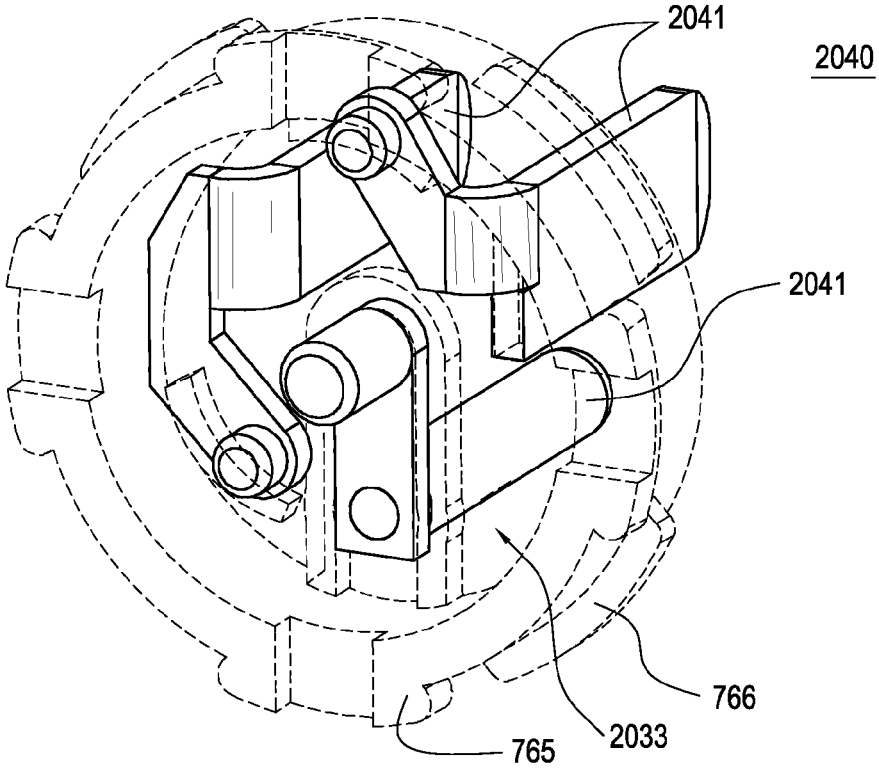
FIG. 22 illustrates a translucent rear view of a prong adapter interchangeable with the prong adapter of FIG. 20-21.

Backtracking through the figures, FIG. 19 illustrates an isometric view of a portion of electrical connector 1900, which is a similar embodiment of electrical connector 100 of FIGS. 1-15 and electrical connector 1600 of FIGS. 16-18. FIG. 20 illustrates a rear view of prong adapter 2030, which is a similar embodiment of prong adapter 330 of FIGS. 1-15, and of prong adapter 1730 of FIGS. 17-18. FIG. 21 illustrates a translucent rear view of prong adapter 2030. FIG. 22 illustrates a translucent rear view of prong adapter 2040, which is interchangeable with prong adapter 2030 in the present example.

As illustrated in FIG. 19, electrical connector 1900 comprises a rotation coupler 1920 similar to rotation coupler 420 (FIG. 4) of electrical connector 100. Like rotation coupler 420 (FIG. 4), rotation coupler 1920 is at least partially enclosed by housing 110 and coupled to electrical outlets 140 (FIG. 1).

Rotation coupler 1920 comprises a central contact 1923, contact set 1921 with two or more contact flanges along perimeter 1931 defined by radius 1941 from central contact 1923, and a contact set 1922 with two or more second contact flanges along perimeter 1932 defined by radius 1942 from central contact 1923. In some examples, contact set 1921 and/or contact set 1922 could be referred to as a flange set. There can also be examples where the contact flanges of rotation coupler 1920 could be referred to as contact points. In the present example, the two or more first contact points of contact set 1921 are evenly separated along perimeter 1931, while the two or more second contact points of contact set 1922 are evenly separated along perimeter 1932.

Central contact 1923 can comprise one of a line contact, a neutral contact, or a ground contact, similar to as described for electrical connector 100 above. In turn, contact set 1921 can comprise a different one of the line contact, the neutral contact, or the ground contact. Finally, contact set 1922 can comprise another one of the line contact, the neutral contact, or the ground contact.

In the present embodiment, the two or more contact flanges of contact set 1921 comprise contact flanges 19211-19214, and the two or more contact flanges of contact set 1922 comprise contact flanges 19221-19224. Perimeters 1931 and 1932 are imaginary, because the perimeters of contact sets 1921 and 1922 do not form a solid ring and are instead composed of discrete contact flanges 19211-19214 and 19221-19224. Central contact 1923 is located within perimeter 1931 of contact set 1921. In addition, perimeter 1931 of contact set 1921 is located within perimeter 1932 of contact set 1922. Central contact 1923, contact set 1921, and contact set 1922 are electrically isolated from each other in rotation coupler 1920.

As illustrated in FIGS. 20-22, electrical connector 1900 further comprises prong adapters 2030 (FIG. 21) and 2040 (FIG. 22), similar to prong adapter 330 of electrical connector 100 (FIGS. 5-6). Prong adapter 2030 is removable from rotation coupler 1920 and replaceable with prong adapter 2040 in the present example. There can be other embodiments, however, where electrical connector 1900 comprises only one of prong adapters 2030 or 2040. Electrical connector 1900 also comprises locking mechanism 760 in the present embodiment, as described above with respect to FIGS. 6-7.

Prong adapter 2030 comprises prong set 2031, having at least two of prong 20311, prong 20312, and prong 20313 accessible at rear 2033 of prong adapter 2030. In some examples, portions of prongs 20311-20313 accessible at rear 2033 can be referred to as couplers. Prong 20311 is configured to couple with contact set 1921 of rotation coupler 1920, and can comprise one of a line prong, a neutral prong, and/or a ground prong, similar to as described for electrical connector 100 above. Prong 20312 is configured to couple with contact set 1922 of rotation coupler 1920, and can comprise a different one of the line prong, the neutral prong, and/or the ground prong. Finally, prong 20313 is configured to couple with central contact 1923, and can comprise another one of the line prong, the neutral prong, and/or the ground prong. In the present example, all three prongs are present in prong set 2031.

Prong adapter 2040 is similar to prong adapter 2030, and is also configured to couple to rotation coupler 1920. As a result, prong adapter 2040 is interchangeable with prong adapter 2030 to couple to rotation coupler 1920. Prong adapter 2040 comprises prong set 2041 with at least two of a line prong, a neutral prong, and/or a ground prong. Similar to prong set 2031 of prong adapter 2030, the prongs of prong set 2041 are configured to protrude and/or be accessible at rear 2033 of prong adapter 2040 at points with radial alignments similar to those discussed above for prong adapter 2030 and corresponding to their respective contacts at rotation coupler 1920. As a result, the line prong, the neutral prong, and/or the ground prong of prong set 2041 are configured to couple with their respective line contact, neutral contact, and ground contact of rotation coupler 1920.

As illustrated in FIGS. 21-22, the shape and arrangement of the prongs on both prong sets 2031 and 2041 differ as they protrude from the front side of prong adapters 2030 and 2040, respectively. In the present example, prong adapter 2030 is configured to be compliant with a first AC prong standard for Australia. Similarly, prong adapter 2040 is configured to be compliant with a second AC prong standard for the United States. Nevertheless, the positional relationship of the prongs at the rear side of both prong adapters 2030 and 2040 is substantially constant in both cases. This arrangement allows flexibility when traveling abroad, permitting the use of electrical connector 1900 on electrical sources of different countries having different AC prong standards by simply coupling the appropriate prong adapter to rotation coupler 1920. As a result, the descriptions herein with respect to prong set 2031 can also be applicable with respect to prong set 2041.

As can be seen in FIGS. 20-22, the different prongs of prong set 2031 are accessible through rear 2033 of prong adapter 2030 in a manner similar to that described above for prong adapter 1730 (FIG. 18), where the different prongs are routed internally to protrude at rear 2033 at locations corresponding to their respective contacts in rotation coupler 1920 (FIG. 19). A similar arrangement is exhibited by prong adapter 2040 through rear 2033, but with respect to prongs set 2041. In the present example, prong 20311 is accessible through an opening at rear 2033 of prong adapter 2030 at a distance of radius 1941 from the center of prong adapter 2030. Because the locations for both prong 20311 and contact set 1921 (FIG. 19) are defined by the same radius 1941, both elements are complementary to each other. As a result, the two or more contact points of contact set 1921 are capable of coupling to only prong 20311 of prong set 2031 when prong adapter 2030 is locked to rotation coupler 1920 by locking mechanism 760.

Similarly, prong 20312 is accessible through an opening at rear 2033 of prong adapter 2030 at a distance of radius 1942 from the center of prong adapter 2030. Because the locations for both prong 20312 and contact set 1922 (FIG. 19) are defined by the same radius 1942, both elements are complementary to each other. As a result, the two or more second contact points of contact set 1922 are capable of coupling to only prong 20312 when prong adapter 2030 is locked to rotation coupler 1920 by locking mechanism 760.

Finally, prong 20313 is accessible through an opening at the center of the rear 2033 of prong adapter 2030, and is thus complementary to central contact 1923, located at the center of rotation coupler 1920 (FIG. 19). As a result, central contact 1923 is capable of coupling to only prong 20313 of prong set 2031 when prong adapter 2030 is locked to rotation coupler 1920 by locking mechanism 760.

Prong adapter 2030 further comprises in the present example one or more safety guards 2032 at rear 2033 configured to at least partially cover one or more of the line prong, the neutral prong, and the ground prong as assigned to prongs 20311-20312. Safety guards 2032 are configured to allow access for the different contacts flanges 19211-19214 and/or 19221-19224 of rotation coupler 1920 to couple with their respective prongs of prong set 2031, while making it harder for users to contact prong set 2031 with their hands or other objects. For example, safety guard 20321 can comprise a wall of channel 20325 over prong 20311, where channel 20325 can channel contact flanges 19211-19214 over prong 20311 when prong adapter 2033 is secured to and rotated relative to rotation coupler 1920. Safety guards 2032 can be portions of a circle and can fit between contact set 1921 and contact set 1922 in the same or other embodiments.

As implemented for electrical connector 1900 in FIG. 19, locking mechanism 760 comprises securing tab set 764 at a perimeter of rotation coupler 1920. Securing tab set 764 is also employed in other embodiments herein described, as seen in FIGS. 4 and 7, for example. Securing tab set 764 comprises one or more securing tabs, such as securing tab 7641, separated by one or more securing notches, such as securing notch 7645 in the present example. In addition, as seen in FIG. 20, locking mechanism 760 also comprises tab set 765 and 766 at a perimeter of prong adapter 2030. Tab sets 765 and 766 are also employed in other embodiments herein described, as seen in FIGS. 5, 6, and 23, for example. Tab set 765 comprises one or more tabs, such as tab 7651, separated by one or more notches, such as notch 7655. Similarly, tab set 766 comprises one or more tabs, such as tab 7661, separated by one or more notches, such as notch 7665. In the present example, lock receivers 7621-7624 are located at tab set 765, and tab set 765 is separated from tab set 766 by at least a thickness of the securing tabs or securing tab set 764 (FIG. 19).

The one or more notches of tab set 765 are vertically aligned with the one or more tabs of tab set 766, and the one or more notches or tab set 766 are vertically aligned with the one or more tabs of tab set 765. As a result, prong adapter 2030 may not be inserted into or removed from rotation coupler 1920 in a single movement. Instead, a series of movements may be required for inserting and/or removing prong adapter 2030 from rotation coupler 1920. Such series of movements may be beneficial, for example, to prevent or restrict unwanted separation of prong adapter 2030 from rotation coupler 1920.

To couple prong adapter 2030 (FIG. 20) with rotation coupler 1920 (FIG. 19) in the present example, the one or more tabs of tab set 765 at prong adapter 2030 can be first inserted into rotation coupler 1920 through the securing notches of securing tab set 764 until the one or more tabs of tab set 766 at prong adapter 2030 contact the one or more tabs of securing tab set 764 over rotation coupler 1920. Prong adapter 2030 can then be rotated until the one or more tabs of tab set 766 are aligned with the one or more securing notches of securing tab set 764, at which point prong adapter 2030 can be further inserted into rotation coupler 1920 until the one or more tabs of tab set 766 lie within rotation coupler 1920 beneath tab set 764. Prong adapter 2030 can then be further rotated until the one or more tabs of tab set 766 are coupled beneath and vertically aligned with the one or more tabs of securing tab set 764 to secure prong adapter 2030 with rotation coupler 1920. In some embodiments, lock deactuator 763 may be pressed to decouple or withdraw lock 761 and thereby permit tab set 766 to couple beneath and vertically align with securing tab set 764. In such embodiments, lock deactuator 763 can then be released to permit lock 761 to couple with one of lock receivers 7621-7624 and thereby restrict the rotational movement of prong adapter 2030 relative to rotation coupler 1920.

In the present example, and in embodiments where prong adapter 2030 comprises prong 20311 of prong set 2031, because of the radial alignments described above, when prong adapter 2030 (FIG. 20) is locked to rotation coupler 1920 (FIG. 19) by the latching of locking mechanism 760 (FIGS. 7 and 19) to any of lock receivers 7621-7624 (FIG. 20), at least one of contact points 19211-19214 of contact set 1921 couples with prong 20311.

Similarly, in the present example, and in embodiments where prong adapter 2030 comprises prong 20312 of prong set 2031, again because of the radial alignments described above, when prong adapter 2030 (FIG. 20) is locked to rotation coupler 1920 (FIG. 19) by the latching of locking mechanism 760 (FIGS. 7 and 19) to any of lock receivers 7621-7624 (FIG. 20), at least one of contact flanges 19221-19224 of contact set 1922 couples with prong 20311.

Finally, in the present example, and in embodiments where prong adapter 2030 comprises prong 20313 of prong set 2031, when prong adapter 2030 (FIG. 20) is coupled to rotation coupler 1920 (FIG. 19), central contact 1923 couples to prong 20313.

As seen in FIG. 19, in the present example contact set 1922 comprises two or more cantilever arms 19225-19228, such that contact flanges 19221-19224 are respectively located at outer ends of cantilever arms 19225-19228. In the present example, the cantilever arms of contact set 1922 extend outwards from a first central junction located at least partially around central contact 1923. In one example, central contact 1923 can be insulated from the first central junction of contact set 1922 via insulating structure 19231, where insulating structure 19231 comprises an insulating material such as plastic. There can be embodiments where the first central junction, contact flanges 19221-19224, and cantilever arms 19228-19228 comprise a single piece.

In the present embodiment, contact set 1921 also comprises two or more cantilever arms similar to cantilever arms 19225-19228 of contact set 1922. The cantilever arms of contact set 1921, however, differ from the cantilever arms of contact set 1922 in that they extend inwards, from a peripheral junction outside perimeter 1932, towards a center of rotation coupler 1920. As a result, contact flanges 19211-19214 are respectively located at inner ends of the cantilever arms of contact set 1921. There can be embodiments where the peripheral junction, contact flanges 19211-19214, and the two or more cantilever arms of contact set 1921 comprise a single piece.

In other embodiments, contact set 1921 can comprise two or more cantilever arms similar to cantilever arms 19225-19228 of contact set 1922, where the cantilever arms of contact set 1921 also extend outwards with respect to central contact 1923. As a result, contact flanges 19211-19214 are respectively located at outer ends of the cantilever arms of contact set 1921 in such embodiments. In the same or other embodiments, the cantilever arms of contact set 1921 can be coupled together at a second central junction similar to the first central junction of contact set 1921, where the second central junction can also be located at least partially around central contact 1923. In such embodiments, the first and second central junctions can be located and/or stacked around insulating structure 19231, separated from each other by, for example, an insulating spacer. In the same or other embodiments, the insulating spacer can be part of insulating structure 19231. There can also be embodiments where only one of contact sets 1921 or 1922 comprises cantilever arms.

Due to their inherent cantilever characteristics, the cantilever arms of contact sets 1921 and/or 1922 can tend to resist elastic deformation when loaded towards their outer ends at any of contact flanges 19211-19214 or 19221-19224. As a result, for example, when rear 2033 of any of prong adapters 2030 or 2040 is pushed against contact flanges 19211-19214 and/or 19221-19224 during coupling with rotation coupler 1920, the cantilever arms of contact sets 1921 and 1922 will tend to resist elastic deformation by cantilevering contact flanges 19211-19214 and/or 19221-19224 against rear 2030. This can be beneficial, for example, to simplify the design and/or manufacture of electrical connector 1900 by avoiding the need to resort to other devices, such as springs, to maintain the contact between contact sets 1921 and 1922 against prong set 2031 of prong adapter 2030. In the present embodiment, when prong adapter 2030 is secured to rotation coupler 1920 as described above, at least one of the cantilever arms of contact set 1921 can cantilever at least one of contact flanges 19211-19214 against prong 20311 at rear 2033 to thereby establish electrical contact. Similarly, at least one of the cantilever arms of contact set 1922 can cantilever at least one of contact flanges 19221-19224 against prong 20312 at rear 2033 to thereby establish electrical contact.

In the present example, the contact arms and flanges of contact sets 1921 and 1922 are staggered in a circular pattern relative to each other around central contact 1923. In addition, the contact flanges 19211-19214 are evenly separated relative to each other around a circular pattern defined by perimeter 1931. Contact flanges 19221-19224 are also evenly separated relative to each other around a circular pattern defined by perimeter 1932. In addition, contact flanges 19211-19214 are evenly separated relative to contact flanges 19221-19224. As an example, in the present embodiment, contact flanges 19221-19221 are separated from each other by approximately 90 degrees, such that flange 19211 is separated from flanges 19212-19214 by approximately 90 degrees, approximately 180 degrees, and approximately degrees, respectively. Similarly, flange 19221 is separated from flanges 19222-19224 by approximately 90 degrees, approximately 180 degrees, and approximately 270 degrees, respectively. In addition, flange 19211 is separated from flange 19221 by approximately 45 degrees.

There can be other embodiments comprising a different number of flanges per flange set. For example, one embodiment (not shown) could comprise a first contact flange set similar to contact set 1921 but comprising only first, second and third contact flanges, where the first contact flange is separated from the second and third contact flanges by approximately 120 degrees and approximately 240 degrees, respectively. The same embodiment can comprise a second contact flange set similar to contact set 1922 but comprising only fourth, fifth, and sixth contact flanges, where the fourth contact flange is separated from the fifth and sixth contact flanges by approximately 120 degrees and approximately 240 degrees, respectively, and where the first contact flange is separated from the fourth contact flange by approximately 60 degrees.

Figure 24:
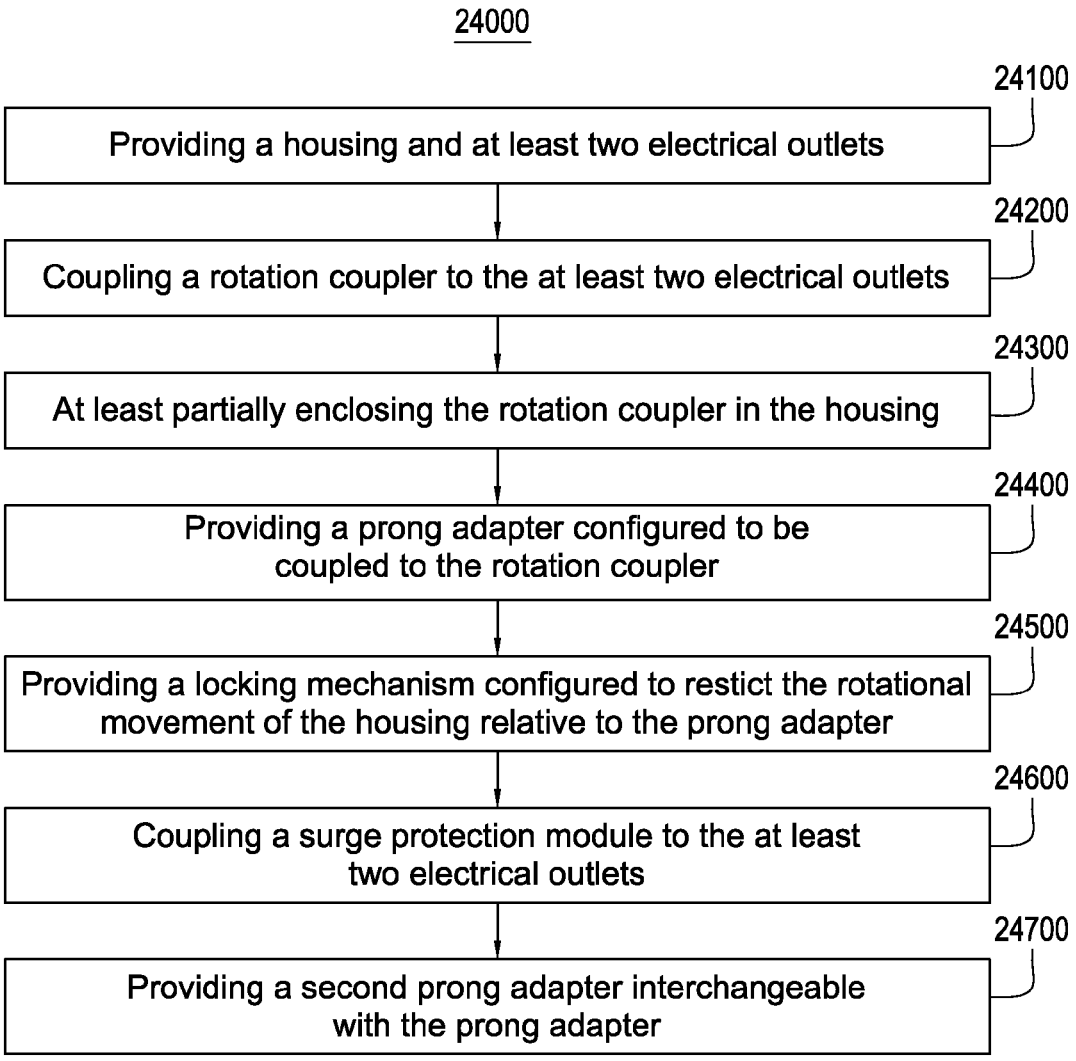
FIG. 24 illustrates a flowchart of a method of manufacturing an electrical connector.

Continuing with the figures, FIG. 24 illustrates a flowchart of a method 24000 for manufacturing an electrical connector. The electrical connector in method 24000 can comprise, for example, electrical connector 100 of FIGS. 1-5, electrical connector 1600 of FIGS. 16-18, and electrical connector 1900 of FIGS. 19-21.

For method 24000, manufacturing the electrical connector can comprise making the electrical connector available to purchasers or users, for example, by the manufacturer of the electrical connector, distributors, marketers, or resellers. The electrical connector can be made available via wholesale distribution methods, and/or through retail networks that cater to midstream parties or end users.

Block 24100 of method 24000 involves providing a housing and at least two electrical outlets. As an example the housing can be housing 110 as shown and described for electrical connector 100 (FIGS. 1-4, and 7-15), housing 110 as shown and described for electrical connector 1900 (FIG. 19), or a similar housing or case from any of the electrical adapters described above. Similarly, the at least two electrical outlets can comprise any of the electrical outlets described above for the different electrical connectors, including AC outlets, USB outlets, Ethernet outlets, and/or telephone jacks. The at least two outlets can be coupled to the housing such that they are accessible externally through the case, while having provisions for connections internally to the housing.

Block 24200 of method 24000 involves coupling a rotation coupler to the at least two electrical outlets. In some examples, block 24200 can comprise providing the rotation coupler before coupling to the at least two electrical outlets. In one example, the rotation coupler can be similar to rotation coupler 420 (FIG. 4) from electrical connector 100, to rotation coupler 1920 (FIG. 19) of electrical connector 1900, or to any rotation coupler or coupling section from any of the electrical connectors described above, and can comprise a line contact, a neutral contact, and a ground contact. The rotation coupler of block 24200 is coupled to the at least two electrical outlets described in block 24100 internally to the housing. In some examples, providing the rotation coupler in block 24200 can comprise providing a first flange set and a second flange set arranged relative to a central contact of the rotation coupler, as described above with respect to contact sets 1921-1922 relative to central contact 1923 of rotation coupler 1920 (FIG. 19)

Block 24300 of method 24000 involves at least partially enclosing the rotation coupler in the housing. As an example, the rotation coupler can be partially enclosed as illustrated for rotation couplers 1620 and 1920 in FIGS. 16 and 19, respectively, wherein the rotation coupler is secured by the housing while leaving an opening for the line, neutral, and ground contacts accessible to the exterior of the housing.

Block 24400 of method 24000 involves providing a prong adapter configured to be coupled to the rotation coupler. In one example, the prong adapter can be similar to prong adapter 330 (FIG. 3) of electrical connector 100 in FIGS. 1-15, to one or both of prong adapters 2030 or 2040 (FIGS. 20-22) of electrical connector 1900 (FIG. 19), or to any other prong adapter described above for other electrical connectors. The prong adapter comprises a prong set comprising at least two of a line prong, a neutral prong, and a ground prong, similar to as described for other prong adapters above. The prong adapter of block 24400 couples to the rotation coupler through the opening at the exterior of the housing described in block 24300. When the prong adapter and the rotation coupler of method 24000 are coupled together, the line contact couples to the line prong, and the neutral contact couples to the neutral prong. In addition, in embodiments comprising a ground prong, the ground contact couples to the ground prong. The rotation coupler of method 24000 is also configured to allow a rotational movement of the housing relative to the prong adapter when the prong adapter is coupled to the rotation coupler, similar to the rotational movement described above for electrical connector 100 with respect to FIGS. 8-15 and/or for electrical connector 1900 with respect to FIGS. 19-22.

In some examples, providing the first and/or second flange sets in block 24200 can comprise providing cantilever arms to cantilever one or more flanges of the first and/or second flange sets when coupling with the prong set of the prong adapter of block 24400. In such examples, the cantilever arms can be similar to the cantilever arms described above for rotation coupler 1920 for contact sets 1921 and/or 1922 (FIG. 19).

Method 24000 can comprise a block 24500, comprising providing a locking mechanism configured to restrict the rotational movement of the housing relative to the prong adapter. The locking mechanism can be similar to locking mechanism 760, as described and/or illustrated above with respect to FIGS. 4-7 for electrical connector 1000, FIGS. 16-18 for electrical connector 1600, FIGS. 19-22 for electrical connector 1900, and/or FIG. 23 for electrical connector 2300.

Method 24000 can also comprise a block 24600, comprising coupling a surge protection module to the at least two electrical outlets. In one example, the surge protection module can be surge protection module 750 as described above for electrical connector 100 in FIG. 7. The surge protector can be contained by the housing, being coupled internally to the housing between the two or more electrical connectors and the rotation coupler.

Method 24000 can further comprise a block 24700, comprising providing a second prong adapter interchangeable with the prong adapter of block 24400. As an example, the second prong adapter can be as described for electrical connector 1900, where second prong adapter 2040 (FIG. 22) is interchangeable with prong adapter 2030 (FIGS. 20-21) for coupling with rotation coupler 1920. The second prong adapter can be compliant with an AC prong standard different than the AC prong standard to which the prong adapter of block 24400 is compliant with.

In one embodiment, blocks 24100, 24200, 24300, 24400, 24500, 24600, and 24700 of method 24000 can be subparts of a single step. In the same or a different embodiment, the sequence of blocks 24100, 24200, 24300, 24400, 24500, 24600, and 24700 of method 24000 can be otherwise changed. Also, blocks 24500, 24600, and 24700 can be optional depending on the specific example of electrical connector being manufactured.

Although the invention has been described with reference to specific embodiments, it will be understood by those skilled in the art that various changes may be made without departing from the spirit or scope of the invention. For example, to one of ordinary skill in the art, it will be readily apparent that the electrical connector can comprise an electrical plug or prong adapter that conforms to European or other country standards, instead of a plug that conforms to United States or Australian standards. In the same or a different example, the electrical connector (and not only the prong adapter) can comprise a two-prong plug, instead of a three-prong plug. In at least some embodiments, the housing can be referred to as a case, the rotation coupler can be referred to as a coupling section, the lock can be referred to as a tab; the lock receivers can be referred to as lock notches, the lock deactuator can be referred to as a lock switch, the prong adapter can be referred to as a revolver platform, and/or the predetermined orientations can be referred to as standard orientations. Additional examples have been given in the foregoing description. Accordingly, the disclosure of embodiments of the invention is intended to be illustrative of the scope of the invention and is not intended to be limiting. It is intended that the scope of the invention shall be limited only to the extent required by the appended claims.

For example, to one of ordinary skill in the art, it will be readily apparent that the electrical connector and method discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An apparatus for providing electrical power, the apparatus comprising:

a housing;

at least two electrical outlets at the housing;

a rotation coupler at least partially enclosed by the housing and coupled to the at least two electrical outlets; and a prong adapter rotatable relative to the rotation coupler when secured to the rotation coupler;

wherein:

the rotation coupler comprises at least two of:

a first contact set comprising a first one of a line contact, a neutral contact, or a ground contact;

a second contact set comprising a second one of the line contact, the neutral contact, or the ground contact; or a central contact comprising a third one of the line contact, the neutral contact, or the ground contact;

the prong adapter comprises a prong set comprising at least two of:

a first prong configured to couple with the first contact set of the rotation coupler and comprising a first one of a line prong, a neutral prong, or a ground prong;

a second prong configured to couple with the second contact set of the rotation coupler and comprising a second one of the line prong, the neutral prong, or the ground prong; or a third prong configured to couple with the central contact of the rotation coupler and comprising a third one of the line prong, the neutral prong, or the ground prong;

the first contact set comprises two or more first contact flanges configured to couple with the first prong at a rear of the prong adapter;

the second contact set comprises two or more second contact flanges configured to couple with the second prong at the rear of the prong adapter;

the two or more first contact flanges are located along a first perimeter defined by a first radius from the central contact;

the two or more second contact flanges are located along a second perimeter defined by a second radius from the central contact;

the central contact is located within the first perimeter of the first contact set;

the first perimeter of the first contact set is located within the second perimeter of the second contact set;

the central contact is electrically isolated from the two or more first contact flanges of the first contact set; and the two or more first contact flanges of the first contact set are electrically isolated from the two or more second contact flanges of the second contact set.

2. An electrical power adapter comprising:

a housing;

at least two electrical outlets accessible through the housing;

a rotation coupler accessible through the housing and coupled to the at least two electrical outlets;

a prong adapter configured to be coupled to the rotation coupler;

a surge protection module coupled to the at least two electrical outlets; and a locking mechanism comprising:

a lock tab coupled to the rotation coupler;

a first lock receiver of two or more lock receivers complementary to the lock tab and coupled to the prong adapter; and a lock switch coupled to the lock tab and protruding through an exterior of the housing;

wherein:

the rotation coupler comprises:

a line contact set located at a first distance from a center of the rotation coupler, the line contact set comprising one or more line contacts;

a neutral contact set located at a second distance from the center of the rotation coupler, the neutral contact set comprising one or more neutral contacts; and a ground contact set located at third distance from the center of the rotation coupler, the ground contact set comprising one or more ground contacts;

the prong adapter comprises a prong set comprising:

a line prong with a line coupler located at a first distance from a center of the prong adapter;

a neutral prong with a neutral coupler located at a second distance from the center of the prong adapter; and a ground prong with a ground coupler located at a third distance from the center of the prong adapter;

the first distance from the center of the rotation coupler is substantially equal to the first distance from the center of the prong adapter;

the second distance from the center of the rotation coupler is substantially equal to the second distance from the center of the prong adapter;

the third distance from the center of the rotation coupler is substantially equal to the third distance from the center of the prong adapter;

when the lock tab is coupled to the first lock receiver:

the line coupler of the line prong is coupled to at least one of the one or more line contacts of the rotation coupler;

the neutral coupler of the neutral prong is coupled to at least one of the one or more neutral contacts of the rotation coupler; and the ground coupler of the ground prong is coupled to at least one of the one or more ground contacts of the rotation coupler;

the rotation coupler is configured to allow a rotational movement of the housing relative to the prong adapter;

the rotational movement of the housing relative to the prong adapter comprises a first standard orientation of two or more standard orientations;

the locking mechanism is configured to restrict the rotational movement of the housing relative to the prong adapter at the first standard orientation when the lock tab is coupled to the first lock receiver;

the locking mechanism is configured to cease restricting the rotational movement of the housing relative to the prong adapter when the lock tab is decoupled from any of the two or more lock receivers;

the lock switch is configured to decouple the lock tab from any of the two or more lock receivers when the locking mechanism is deactuated via the lock switch; and the at least two electrical outlets comprise at least one of:

an AC outlet;

a USB socket;

an Ethernet socket; or a telephone jack.

3. The apparatus of claim 1, wherein:

the first contact set comprises two or more first cantilever arms;

the two or more first contact flanges are located at first outer ends of the two or more first cantilever arms; and at least one of the two or more first cantilever arms cantilevers at least one of the two or more first contact flanges against the first prong when the prong adapter is secured to the rotation coupler.

4. The apparatus of claim 3, wherein:

the two or more first cantilever arms comprise first inner ends coupled together at a first central junction located at least partially around a perimeter of the central contact.

5. The apparatus of claim 4, wherein:

the second contact set comprises two or more second cantilever arms;

the two or more second contact flanges are located at inner ends of the two or more second cantilever arms;

at least one of the two or more second cantilever arms cantilevers at least one of the two or more second contact flanges against the second prong when the prong adapter is secured to the rotation coupler;

the two or more second cantilever arms comprise outer ends coupled together at a peripheral junction located past the first perimeter;

the central contact, the first central junction, and the peripheral junction are electrically isolated from each other; and the first and second cantilever arms are staggered in a circular pattern relative to each other.

6. The apparatus of claim 4, wherein:

the second contact set comprises two or more second cantilever arms;

the two or more second contact flanges are located at second outer ends of the two or more second cantilever arms;

at least one of the two or more second cantilever arms cantilevers at least one of the two or more second contact flanges against the second prong when the prong adapter is secured to the rotation coupler;

the two or more second cantilever arms comprise second inner ends coupled together at a second central junction located at least partially around the perimeter of the central contact;

the central contact, the first central junction, and the second central junction are electrically isolated from each other; and the first and second cantilever arms are staggered in a circular pattern relative to each other.

7. The apparatus of claim 1, wherein:

the prong adapter is rotatable 360 degrees relative to the prong adapter.

8. The apparatus of claim 1, further comprising:

a surge protection module contained within the housing and coupled to the at least two electrical outlets;

wherein the at least two electrical outlets comprise at least one of:

an AC outlet; a USB socket; an Ethernet socket; or a telephone jack.

9. The apparatus of claim 1, wherein:

the prong adapter further comprises:

one or more openings at a rear of the prong adapter; and one or more safety guards at the rear of the prong adapter;

the first prong, the second prong, and the third prong are routed between the front of the prong adapter and the rear of the prong adapter to be accessible via the one or more openings at the rear of the prong adapter; and at least a first one of the first prong, the second prong, or the third prong is partially covered at the rear of the prong adapter by at least a first one of the one or more safety guards.

10. The apparatus of claim 9, wherein:

the first one of the one or more safety guards comprises a wall of a channel over the at least the first one of the first prong, the second prong, or the third prong at the rear of the prong adapter; and at least one of the central contact, the first contact set, or the second contact set of the rotation coupler is routed through the channel to contact the at least the first one of the first prong, the second prong, or the third prong when the prong adapter is secured to the rotation coupler.

11. The apparatus of claim 1, further comprising:

a second prong adapter comprising a second prong set, the second prong set comprising at least two of:

a fourth prong configured to couple with the first contact set of the rotation coupler;

a fifth prong configured to couple with the second contact set of the rotation coupler; or a sixth prong configured to couple with the central contact of the rotation coupler;

wherein:

the prong adapter is removable from the rotation coupler;

the second prong adapter is interchangeable with the prong adapter for securing to the rotation coupler;

the prong adapter is compliant with a first prong standard; and the second prong adapter is compliant with a second prong standard.

12. The apparatus of claim 1, wherein:

the rotation coupler further comprises a first portion of a locking mechanism;

the first portion of the locking mechanism comprises a lock;

the prong adapter further comprises a second portion of the locking mechanism;

the second portion of the locking mechanism comprises a first lock receiver of two or more lock receivers configured to couple with the lock;

a rotational movement of the housing relative to the prong adapter comprises a first predetermined orientation of two or more predetermined orientations; and the locking mechanism is configured to:

restrict the rotational movement of the housing relative to the prong adapter at the first predetermined orientation when the lock is coupled to the first lock receiver; and permit the rotational movement of the housing relative to the prong adapter when the lock is decoupled from the first lock receiver.

13. The apparatus of claim 12, wherein:

the two or more predetermined orientations are separated from each other by one or more multiples of 45 degrees of rotation.

14. The apparatus of claim 12, wherein:

the first portion of the locking mechanism further comprises:

a securing tab set at a perimeter of the rotation coupler, the securing tab set comprising one or more securing tabs separated by one or more securing notches;

the second portion of the locking mechanism further comprises:

a first tab set at a perimeter of the prong adapter, the first tab set comprising one or more first tabs separated by one or more first notches; and a second tab set at the perimeter of the prong adapter, the first tab set comprising one or more second tabs separated by one or more second notches;

the two or more lock receivers are located at the one or more second tabs;

the first tab set is separated from the second tab set by a distance of at least a thickness of the one or more securing tabs of the securing tab set;

the one or more first notches are aligned with the one or more second tabs between the front and the rear of the prong adapter;

the one or more second notches are aligned with the one or more first tabs between the front and the rear of the prong adapter;

the first tab set is closer to the rear of the prong adapter than the second tab set; and the one or more second tabs are located beneath the one or more securing tabs when the lock is coupled to the first lock receiver.

15. The apparatus of claim 1, further comprising:

a locking mechanism configured to restrict the rotational movement at one or more predetermined orientations of the housing relative to the prong adapter;

wherein:

the two or more first contact flanges of the first contact set are configured to electrically couple at the rear of the prong adapter with only the first prong of the prong set when the prong adapter is locked to the rotation coupler by the locking mechanism;

at least one of the two or more first contact flanges of the first contact set is coupled with the first prong when the prong adapter is locked to the rotation coupler by the locking mechanism;

the two or more second contact flanges of the second contact set are configured to electrically couple at the rear of the prong adapter with only the second prong of the prong set when the prong adapter is locked to the rotation coupler by the locking mechanism;

at least one of the two or more second contact flanges of the second contact set is coupled with the second prong when the prong adapter is locked to the rotation coupler by the locking mechanism; and the central contact is configured to electrically couple at the rear of the prong adapter with only the third prong of the prong set when the prong adapter is coupled to the rotation coupler, regardless of whether the prong adapter is locked to the rotation coupler by the locking mechanism.

16. The apparatus of claim 1, wherein:

the two or more first contact flanges are evenly separated relative to each other;

the two or more second contact flanges are evenly separated relative to each other; and the two or more first contact flanges and the two or more second contact flanges are evenly separated relative to each other.

17. The apparatus of claim 1, wherein:

the two or more first contact flanges comprise:

first, second, third, and fourth contact flanges;

the two or more second contact flanges comprise:

fifth, sixth, seventh, and eigth contact flanges;

the first contact flange is:

separated from the second contact flange by approximately 90 degrees;

separated form the third contact flange by approximately 180 degrees; and separated from the fourth contact flange by approximately 270 degrees;

the fifth contact flange is:

separated from the sixth contact flange by approximately 90 degrees;

separated form the seventh contact flange by approximately 180 degrees; and separated from the eight contact flange by approximately 270 degrees; and the first contact flange is separated from the fifth contact flange by approximately 45 degrees.

18. The apparatus of claim 1, wherein:

the two or more first contact flanges comprise:

first, second, and third, contact flanges;

the two or more second contact flanges comprise:

fourth, fifth, and sixth contact flanges;

the first contact flange is:

separated from the second contact flange by approximately 120 degrees; and separated form the third contact flange by approximately 240 degrees;

the fourth contact flange is:

separated from the fifth contact flange by approximately 120 degrees; and separated form the sixth contact flange by approximately 240 degrees; and the first contact flange is separated from the fourth contact flange by approximately 60 degrees.

19. A method of manufacture for an electrical connector, the method comprising:

providing a housing having at least two electrical outlets;

providing a rotation coupler coupled to the at least two electrical outlets;

at least partially enclosing the rotation coupler in the housing; and providing a prong adapter comprising a prong set, the prong adapter rotatable when coupled with the rotation coupler;

wherein:

providing the prong adapter comprises at least two of:

providing a first prong of the prong set to comprise a first one of a line prong, a neutral prong, or a ground prong;

providing a second prong of the prong set to comprise a second one of the line prong, the neutral prong, or the ground prong; or providing a third prong of the prong set to comprise a third one of the line prong, the neutral prong, or the ground prong;

providing the rotation coupler comprises at least two of:

providing a first flange set configured to electrically couple with the first prong at a rear of the prong adapter, the first contact set comprising a first one of a line contact, a neutral contact, or a ground contact;

providing a second flange set configured to electrically couple with the second prong at the rear of the prong adapter, the second contact set comprising a second one of the line contact, the neutral contact, or the ground contact; or providing a central contact configured to electrically couple with the third prong at the rear of the prong adapter, the central contact comprising a third one of the line contact, the neutral contact, or the ground contact;

providing the first flange set comprises:

distributing the first flange set evenly along a first perimeter defined by a first radius from the central contact, the first radius extending past a perimeter of the central contact; and providing the second flange set comprises:

distributing the second flange set evenly along a second perimeter defined by a second radius from the central contact, the second radius greater than the first radius; and distributing the second flange set evenly staggered with the first flange set.

20. The method of claim 19, wherein:

providing the first flange set comprises:

providing two or more first cantilever arms comprising inner ends coupled together at a first junction;

locating the first junction at least partially around and isolated from a perimeter of the central contact;

locating the first flange set at outer ends of the two or more first cantilever arms; and providing at least one of the two or more first cantilever arms to cantilever at least one flange of the first flange set against the first prong at the rear of the prong adapter.

21. The method of claim 20, wherein:

providing the second flange set comprises:

providing two or more second cantilever arms comprising inner ends coupled together at a second junction;

locating the second junction at least partially around and isolated from a perimeter of the central contact;

locating the second flange set at outer ends of the two or more second cantilever arms;

locating the second flange set staggered in a circular pattern with the first flange set; and providing at least one of the two or more second cantilever arms to cantilever at least one flange of the second flange set against the second prong at the rear of the prong adapter.

22. The method of claim 20, wherein:

providing the second flange set comprises:

providing two or more second cantilever arms comprising outer ends coupled together at a peripheral junction;

locating the peripheral junction outside the first perimeter;

locating the second flange set at inner ends of the two or more second cantilever arms; and providing at least one of the two or more second cantilever arms to cantilever at least one flange of the second flange set against the second prong at the rear of the prong adapter.

23. The method of claim 19, wherein:

providing the prong adapter comprises:

providing one or more openings at a rear of the prong adapter;

providing the first, second, and third prongs to be routed between a front of the prong adapter and the rear of the prong adapter to be accessible via the one or more openings at the rear of the prong adapter; and providing at least a first safety guard of one or more safety guards at the rear of the prong adapter, the first safety guard at least partially covering one of the first, second, or third prongs at the rear of the prong adapter.

24. The method of claim 19, wherein:

providing the rotation coupler comprises:

providing a locking tab at a perimeter of the rotation coupler;

providing the prong adapter comprises:

providing a first lock receiver of two or more lock receivers at a perimeter of the prong adapter, the two or more lock receivers configured to couple with the locking tab at predetermined orientations of the prong adapter relative to the rotation coupler;

providing the first flange set comprises:

locating a flange of the first flange set to couple with the first prong at the rear of the prong adapter only when the locking tab is aligned with the first lock receiver and the prong adapter is coupled to the rotation coupler;

and providing the second flange set comprises:

locating a flange of the second flange set to couple with the second prong at the rear of the prong adapter only when the locking tab is aligned with the first lock receiver and the prong adapter is coupled to the rotation coupler.

25. The electrical power adapter of claim 2, wherein:

a first one of the line contact set, the neutral contact set, or the ground contact set comprises:

a first cantilever arm set; and a first flange set comprising one or more first flanges at outer ends of one or more cantilever arms of the first cantilever arm set;

and a first flange of the one or more first flanges is cantilevered against a first one of the line coupler, the neutral coupler, or the ground coupler of the prong adapter when the lock tab is coupled to the first lock receiver.

26. The method of claim 19, wherein:

providing the first flange set comprises:

providing a first flange;

providing a second flange at approximately 90 degrees from the first flange;

providing a third flange at approximately 180 degrees from the first flange; and providing a fourth flange at approximately 270 degrees from the first flange; and providing the second flange set comprises:

providing a fifth flange at approximately 45 degrees from the first flange;

providing a sixth flange at approximately 90 degrees from the fifth flange;

providing a seventh flange at approximately 180 degrees from the fifth flange; and providing an eighth flange at approximately 270 degrees from the fifth flange.

27. The electrical power adapter of claim 2, further comprising:

a second prong adapter configured to be coupled to the rotation coupler;

wherein:

the second prong adapter is interchangeable with the prong adapter;

the prong adapter is compliant with a first prong standard from a first country; and the second prong adapter is compliant with a second prong standard from a second country.

* * * * *